US010185290B2

(12) United States Patent
Hasegawa

(10) Patent No.: US 10,185,290 B2
(45) Date of Patent: Jan. 22, 2019

(54) ELECTRONIC TIMEPIECE

(71) Applicant: CASIO COMPUTER CO., LTD., Shibuya-ku, Tokyo (JP)

(72) Inventor: Kosuke Hasegawa, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 53 days.

(21) Appl. No.: 14/975,321

(22) Filed: Dec. 18, 2015

(65) Prior Publication Data

US 2016/0209813 A1 Jul. 21, 2016

(30) Foreign Application Priority Data

Jan. 16, 2015 (JP) ..... 2015-006627

(51) Int. Cl.
*G04R 20/02* (2013.01)
*G04G 9/00* (2006.01)

(52) U.S. Cl.
CPC ..... *G04R 20/02* (2013.01); *G04G 9/0076* (2013.01)

(58) Field of Classification Search
CPC ..... G04R 20/04; G04R 20/02; G04R 20/00; G04G 9/0076
See application file for complete search history.

(56) References Cited

U.S. PATENT DOCUMENTS 5,237,544 A 8/1993 Sase et al.
8,077,550 B2 * 12/2011 Akiyama ..... G04R 20/06 368/21
8,493,816 B2 * 7/2013 Akiyama ..... G04R 20/06 368/21
2009/0135675 A1 * 5/2009 Akiyama ..... G04R 20/06 368/14
2009/0190444 A1 7/2009 Akiyama et al.
2011/0280108 A1 11/2011 Honda

FOREIGN PATENT DOCUMENTS

JP 03059492 A 3/1991
JP 2009085606 A 4/2009
JP 2009180528 A 8/2009
JP 2011237314 A 11/2011

OTHER PUBLICATIONS

Japanese Office Action (and English translation thereof) dated Dec. 6, 2016, issued in counterpart Japanese Application No. 2015-006627.

* cited by examiner

*Primary Examiner* — Sean Kayes
(74) *Attorney, Agent, or Firm* — Holtz, Holtz & Volek PC

(57) ABSTRACT

An electronic timepiece includes a storage unit and a processor. The storage unit associates and stores local time information with a corresponding geographical position. The local time information corresponds to each of a plurality of predetermined geographical positions. The processor acquires local time information corresponding to a geographical position selected from the plurality of geographical positions, as update information of a predetermined region including the selected geographical position. When update information corresponding to a target position for setting local time is acquired, the processor sets the local time by referring to the acquired update information. When the update information corresponding to a target position for setting local time is not acquired, the processor sets the local time by referring to the local time information.

16 Claims, 13 Drawing Sheets

(FIG. 7 CONTINUED)
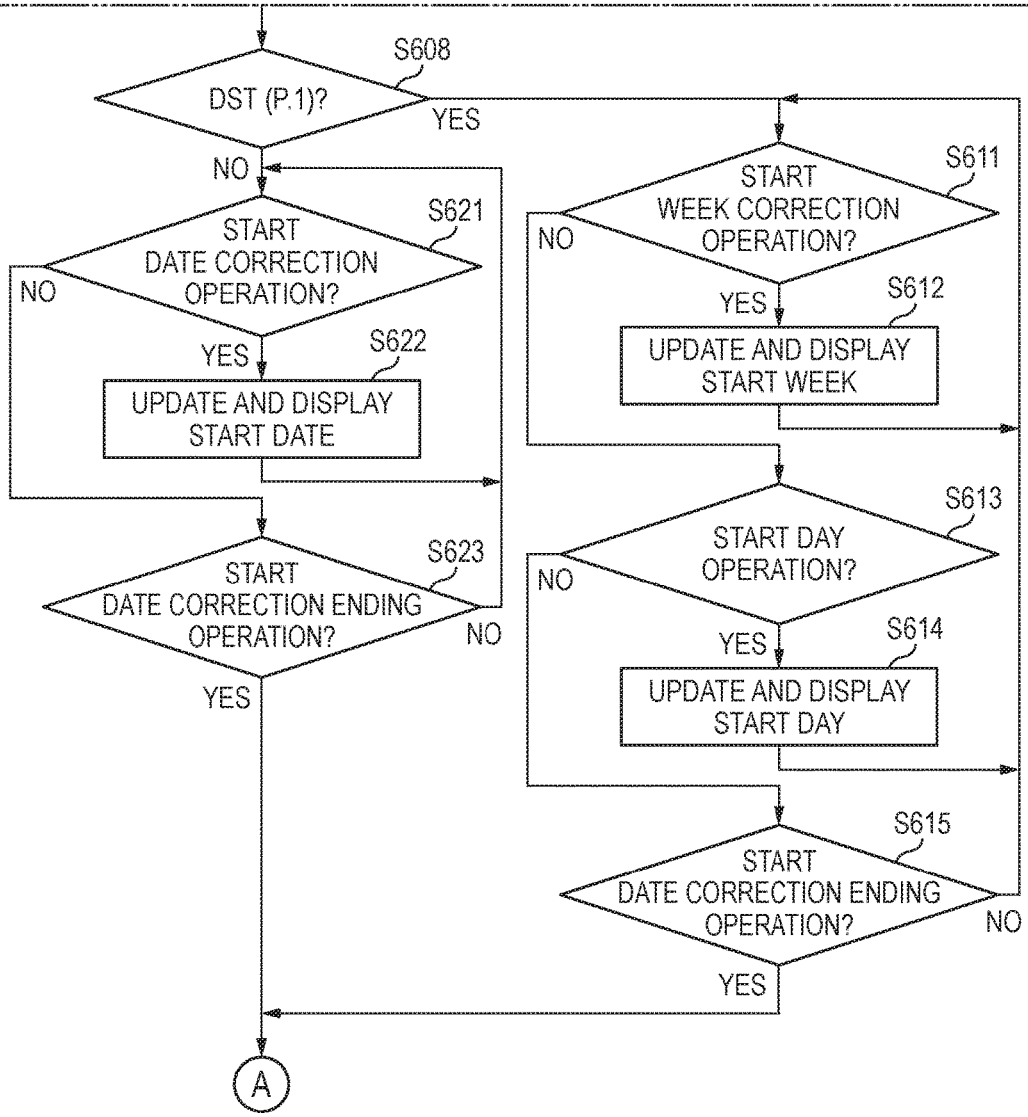

(FIG. 8 CONTINUED)
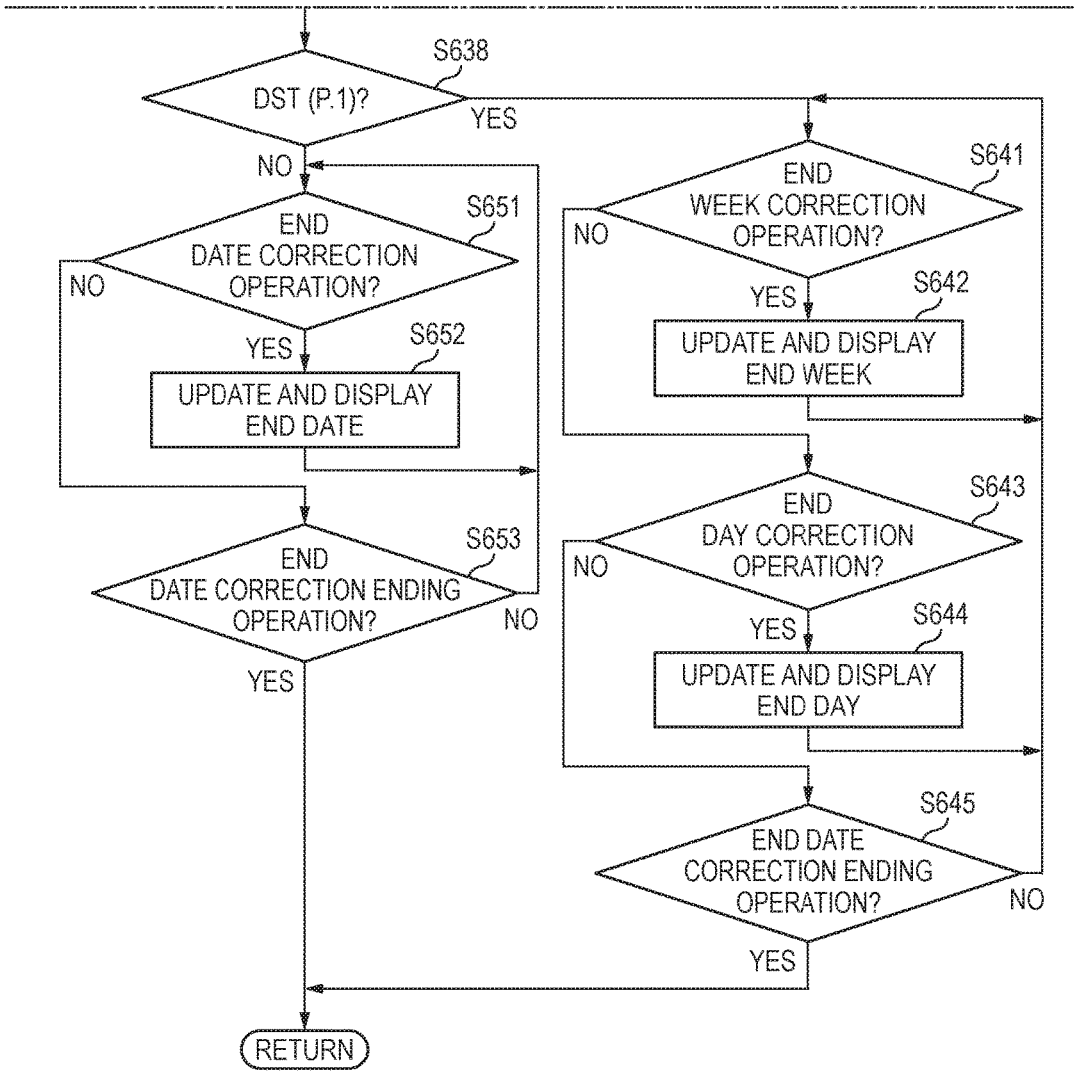

ELECTRONIC TIMEPIECE

CROSS-REFERENCE TO RELATED APPLICATION

This application is based upon and claims the benefit of priority from the prior Japanese Patent Application No. 2015-006627, filed on Jan. 16, 2015, and the entire contents of which are incorporated herein by reference.

BACKGROUND OF THE INVENTION

1. Field of the Invention

The present invention relates to an electronic timepiece configured to set and compute local time.

2. Description of the Related Art

In the related art, there has been known an electronic timepiece having a world time clock function of keeping information about respective time zones of the world, selecting an appropriate time zone in correspondence to acquired positional information and displaying dates and times (local times) of various regions of the world. In the electronic timepiece, positioning data and a city selected by a user operation are used as the positional information. Also, an electronic timepiece configured to keep implementation information of the daylight-saving time in addition to the information of the time zones and to automatically display the daylight-saving time during an implementation time period of the daylight-saving time in an implementation region of the daylight-saving time has been known. According to this electronic timepiece, when the positional information is once acquired, it is possible to display the correct local time without the user needing to check or adjust a setting relating to the local time, such as the time zone, whether the daylight-saving time is to be implemented, the implementation time period of the daylight-saving time and the like.

According to the electronic timepiece having the world time clock function, in order to correctly acquire the setting relating to the local time, it is necessary to associate and keep the positional information and the information about the time zone and the implementation region of the daylight-saving time. For example, JP-A-2009-180528 discloses a technology of dividing the world into geographically detailed blocks, keeping map data in which the time zone and the implementation region of the daylight-saving time are stored with being associated with the respective divided blocks, and enabling the correct local time corresponding to the time zone and the daylight-saving time over the world as well as the big city for which the time zone could be conventionally set.

However, the time zone setting of the world and the implementation setting of the daylight-saving time are frequently varied depending on political and religious situations, economic needs and the like. Most of the electronic timepieces, particularly, the portable timepieces have a limitation on a function of transmitting and receiving data to and from the outside, so that it is difficult to update the map data having a large size. Therefore, in a city and a region in which the local time setting information being kept has been changed, after the local time based on the old local time setting information is acquired or the user moves to another city or region, it is necessary for the user to correct the local time setting information each time.

SUMMARY OF THE INVENTION

It is therefore an object of the present invention to provide an electronic timepiece capable of acquiring correct local time easily and continuously, in correspondence to a change of a time zone setting and an implementation setting of the daylight-saving time.

In order to achieve the above object, the present invention provides an electronic timepiece includes a storage unit and a processor. The storage unit associates and stores local time information with a corresponding geographical position. The local time information corresponds to each of a plurality of predetermined geographical positions. The processor acquires local time information corresponding to a geographical position selected from the plurality of geographical positions, as update information of a predetermined region including the selected geographical position. When update information corresponding to a target position for setting local time is acquired, the processor sets the local time by referring to the acquired update information. When the update information corresponding to a target position for setting local time is not acquired, the processor sets the local time by referring to the local time information.

DETAILED DESCRIPTION

Hereinafter, an illustrative embodiment of the present invention will be described with reference to the drawings.

Figure 1:
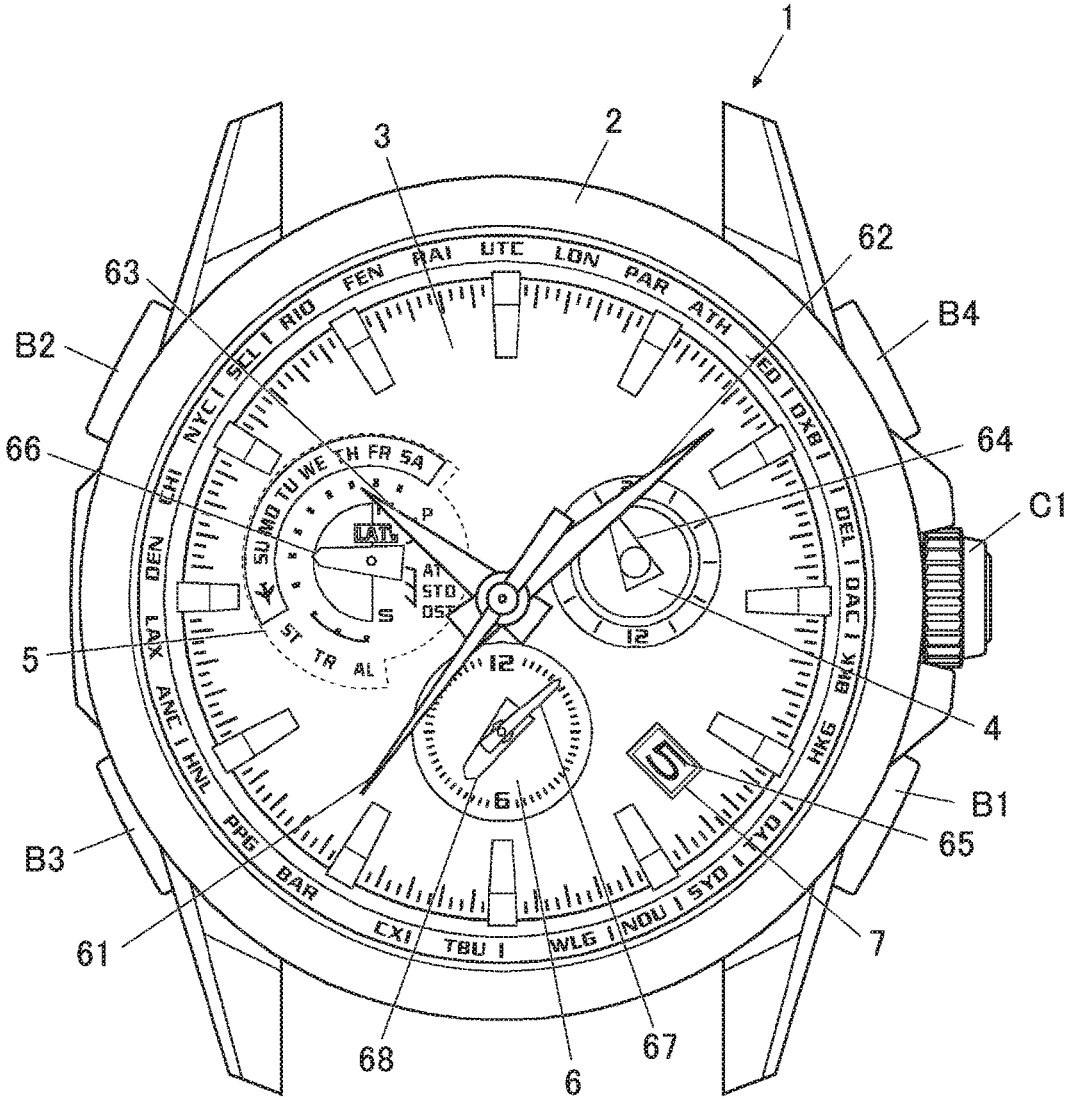
FIG. 1 is a plan view of an analog electronic timepiece according to an illustrative embodiment of the present invention.

FIG. 1 is a front view of an analog electronic timepiece 1, which is an illustrative embodiment of the electronic timepiece of the present invention.

The analog electronic timepiece 1 includes a casing 2 configured to accommodate therein respective configurations, a dial plate 3 of which one surface (exposed surface) is externally exposed in the casing 2, a transparent member (windproof glass) (not shown) configured to cover the exposed surface of the dial plate 3, three time indicators 61, 62, 63 configured to rotate about a substantial center (rotational shaft) of the dial plate 3 over a substantially entire surface of the dial plate 3 between the dial plate 3 and the windproof glass and to indicate marks and scales provided in the vicinity of an outer edge of the dial plate 3, a small window 4 provided at a three thirty position of the dial plate 3, a 24-hour hand 64 configured to rotate in the small window 4, a region 5 defined at a nine thirty position of the dial plate 3, a mode indicator 66 configured to rotate in the region 5, a small window 6 provided at a 6 o'clock position of the dial plate 3, a small minute hand 67 and a small hour hand 68 configured to rotate in the small window 6, a date wheel 65 provided on an opposite side to the exposed surface of the dial plate 3 in parallel with the dial plate 3 and configured to expose one mark thereof from an opening 7 provided at a four thirty position of the dial plate 3 in correspondence to a rotating operation, a stem C1 and push-button switches B1 to B4 provided on a side surface of the casing 2 with respect to the exposed surface of the dial plate 3, and the like.

The dial plate 3 is provided with scales and marks (hour characters) indicative of an hour, a minute and a second in a circular ring shape, and is also provided at an outermore edge than the scales and the marks with marks (city marks) indicative of abbreviations of city names corresponding to time zones of the world and coordinate universal time (UTC).

The time indicators 61 to 63 are a second hand 61, a minute hand 62 and an hour hand 63, respectively, and are usually configured to indicate an hour, a minute and a second of time when displaying time. The 24-hour hand 64 is configured to display 24 hours including ante meridiem and post meridiem in the small window 4. Also, in the analog electronic timepiece 1 of the illustrative embodiment, the second hand 61 and the minute hand 62 are used for display and setting of various functions.

The date wheel 65 has marks, which are indicative of dates and are equidistantly provided in number order at a peripheral edge portion thereof. One of the marks is exposed from the opening 7, thereby indicating a date.

The mode indicator 66 is configured to indicate a day of week by indicating any one of seven marks provided between a 9 o'clock position and a 1 o'clock position in the region 5, and to indicate a function mode under execution by indicating any one of marks provided between a 6 o'clock position and a seven thirty position in the region 5. The function modes that can operate in the analog electronic timepiece 1 include, but are not particularly limited to, a stopwatch mode, a timer mode and an alarm mode. Also, when the mode indicator indicates one of marks provided between a 3 o'clock position and a 5 o'clock position, a display relating to a display setting of the daylight-saving time is performed with respect to the time display mode. Also, an airplane mode of prohibiting communication radio waves from being transmitted and received can be set in parallel with the various function modes. When the mode indicator 66 indicates an airplane mark close to the 9 o'clock position, the airplane mode is displayed. Further, a latitude is displayed by an angle (i.e., a position indicated by the mode indicator 66) between a direction indicated by the mode indicator 66 and a 9 o'clock direction (a horizontal direction when a 12 o'clock direction faces upward).

The small minute hand 67 and the small hour hand 68 are configured to make a time display relating to the world time clock function in the small window 6, respectively. That is, the analog electronic timepiece 1 of the illustrative embodiment can display the local times of two regions at the same time by the time indicators 61 to 63 and the small minute hand 67 and the small hour hand 68. In the meantime, the 24-hour hand 64 configured to rotate in conjunction with the small minute hand 67 and the small hour hand 68 is additionally provided to display ante meridiem and post meridiem.

In the below, when collectively describing some or all of the time indicators 61 to 63, the 24-hour hand 64, the date wheel 65, the mode indicator 66, the small minute hand 67 and the small hour hand 68, the description 'indicators 61 to 68' is made.

The stem C1 and the push-button switches B1 to B4 are respectively configured to receive an input operation from a user. The stem C1 can be pulled out in two steps from the casing 2. At a one or two-step pullout state, when the stem is rotated by a predetermined angle is performed, an operation signal is output, which is then used for various settings. When each of the push-button switches B1 to B4 is pushed, a type of the function mode is changed or an operation command allotted to each of the function modes is received.

Figure 2:
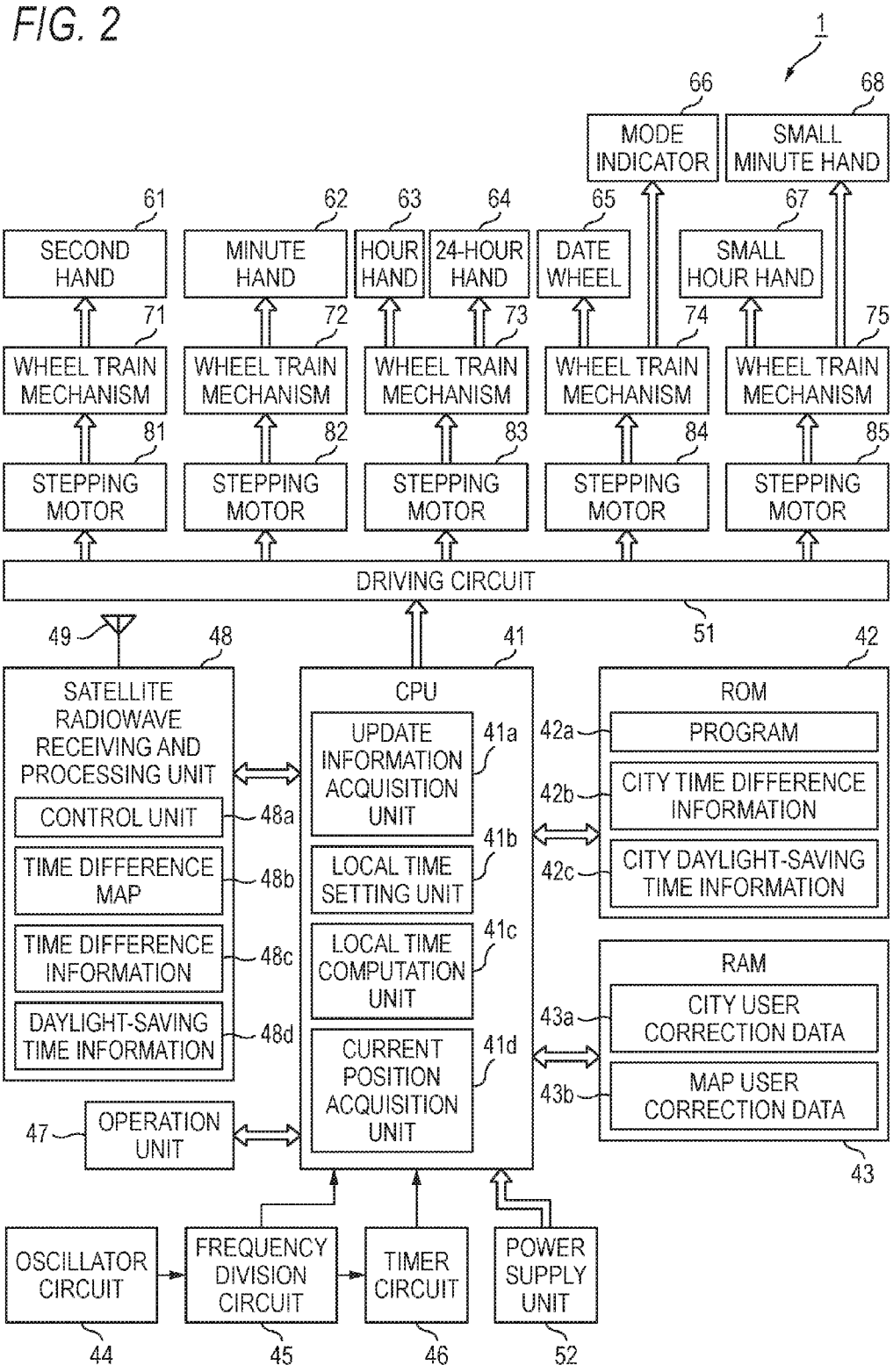
FIG. 2 is a block diagram depicting a functional configuration of the analog electronic timepiece.

FIG. 2 is a block diagram depicting a functional configuration of the analog electronic timepiece 1.

The analog electronic timepiece 1 includes a CPU 41 (Central Processing Unit) (an update information acquisition unit 41*a*, a local time setting unit 41*b*, a local time computation unit 41*c*, a current position acquisition unit 41*d*), a ROM 42 (Read Only Memory), a RAM 43 (Random Access Memory) (the update information storage unit), an oscillator circuit 44, a frequency division circuit 45, a timer circuit 46 serving as the timer unit, an operation unit 47 serving as the operation unit, a satellite radio wave receiving and processing unit 48 (the reception unit, the position computation unit), an antenna 49 thereof, a driving circuit 51, a power supply unit 52, the time indicators 61 to 63, the 24-hour hand 64, the date wheel 65, the mode indicator 66, the small minute hand 67, the small hour hand 68, wheel train mechanisms 71 to 75, stepping motors 81 to 85, and the like. The CPU 41 includes an update information acquisition unit 41*a*, a local time setting unit 41*b*, a local time computation unit 41*c*, and a current position acquisition unit 41*d*. The update information acquisition unit 41*a*, the local time setting unit 41*b*, the local time computation unit 41*c* and the current position acquisition unit 41*d* may be a single CPU or may perform respective operations by CPUs separately provided.

The CPU 41 is configured to execute a variety of computation processing and to collectively control the entire operations of the analog electronic timepiece 1. The CPU 41 is configured to control an indicator operation relating to the display of date and time. The CPU 41 is configured to convert date and time, which is to be counted by the timer circuit 46, into appropriate local time based on local time setting information (local time information) having set time zones and implementation information of the daylight-saving time, and to display the converted local time in a usual time display mode by the time indicators 61 to 63, the 24-hour hand 64 and the date wheel 65.

Also, the CPU 41 is configured to operate the satellite radio wave receiving and processing unit 48 to acquire the date and time and the positional information. The CPU 41 is configured to correct the date and time that is to be counted by the timer circuit 46, based on the obtained data of the date and time.

The ROM 42 is configured to store therein a program 42*a* for control, which is to be executed by the CPU 41, and setting data. The program 42*a* includes a program relating to operation control of various function modes, for example. Also, the setting data includes city time difference information 42*b* and city daylight-saving time information 42*c*.

In the city time difference information 42*b*, IDs of geographical positions relating to the city marks (abbreviations of city names) provided at the outer edge of the dial plate 3, positions (for example, the number of steps by the second hand 61 in a 12 o'clock direction) and time differences from the UTC time in the cities (hereinafter, the time difference indicates a time difference from the UTC time) are associated and stored as the time zone setting information. For example, regarding a city mark 'TYO' provided in the vicinity of a four twenty position and indicating Tokyo, an ID '011', a 22-second position and the time difference of +9 hours are associated and stored.

Also, in the city daylight-saving time information 42*c*, each city and the daylight-saving time implementation information in the city, i.e., the information about whether the daylight-saving time is to be implemented, an implementation time period (a start date and an end date) and shift time from the standard time during the implementation time period of the daylight-saving time are associated and stored. For example, regarding a city mark 'LON' provided at a 2-second position and indicating London, an ID '002', a position (2-second position), an implementation time period of the daylight-saving time (from UTC 1 o'clock of last Sunday in March to UTC 1 o'clock of last Sunday in October) and shift time (+1 hour) during the daylight-saving time implementation time period are associated and stored.

The RAM 43 is configured to provide the CPU 41 with a memory space for work and to store therein temporary data. Also, in the RAM 43, an acquisition hysteresis of the date and time information and positional information, the local time setting information including the currently selected time zone and the daylight-saving time implementation information, data indicating an indicator position, and the like are stored. Also, in the RAM 43, city user correction data 43*a* and map user correction data 43*b*, which are correction data of the time zone and daylight-saving time implementation information set by the user, are stored.

When correction information of the time zone and the daylight-saving time implementation information in each city is set, the correction information is stored in the city user correction data 43*a*. For example, when the daylight-saving time is implemented in Tokyo, if the daylight-saving time implementation information is set by the user, as described later, an ID indicating Tokyo and the like and the corresponding setting are associated and stored. The storing number of the setting may be the latest one, and the setting may be stored for all cities for which the setting is made. When a plurality of settings is made for the same city (ID), only the latest setting is stored. Also, the correction information may include an effective period of the correction information.

In the map user correction data 43*b*, as described later, when the correction information of the time zone and daylight-saving time implementation information at the acquired current position (the latitude and the longitude) is set, an ID of the current position or a region (a predetermined region) including the current position and the set correction information are associated and stored. When the data indicating the current position is stored, the latitude and the longitude of the acquired current position may be used or coordinates of each geographical block stored in a time difference map 48*b* may be used. Also in this case, the number of settings is appropriately set in correspondence to the storage capacity and the like, and when a plurality of settings is made in the same region, only the latest setting is stored. This correction information may also include an effective period of the correction information.

The city user correction data 43*a* and the map user correction data 43*b* configure the update information.

The oscillator circuit 44 is configured to generate and output a predetermined frequency signal. The oscillator circuit 44 has a quartz oscillator, for example.

The frequency division circuit 45 is configured to divide the frequency signal output from the oscillator circuit 44 into signals of frequencies that are to be used by the CPU 41 and the timer circuit 46, and to output the same. The frequency to be output may be set to be changeable by a control signal from the CPU 41.

The timer circuit 46 is configured to count current date and time by counting and adding the frequency division signal input from the frequency division circuit 45 to an initial value indicating predetermined date and time. The date and time that is to be counted by the timer circuit 46 has an error (rate) corresponding to a degree of precision of the oscillator circuit 44, for example, about 0.5 second per one day. The date and time that is to be counted by the timer circuit 46 can be corrected by a control signal from the CPU 41.

The operation unit 47 is configured to receive an input operation from the user. The operation unit 47 includes the push-button switches B1 to B4 and the stem C1. When the push-button switches B1 to B4 are respectively pushed or when the stem C1 is pulled out, pushed back or rotated, an electric signal corresponding to a type of the operation is output to the CPU 41. The stem C1 can be pulled out in two steps and receive an operation of a content corresponding to the pullout state.

The satellite radio wave receiving and processing unit 48 is configured to receive radio waves from positioning satellites including positioning satellites (GPS satellites) relating to at least a GPS (Global Positioning System) by using the antenna 49, and to demodulate spectrum-spread transmission radio waves from the positioning satellites, thereby decoding and deciphering signals (navigation message data). A variety of computation processing is additionally performed for contents of the deciphered navigation message data, as required, and data corresponding to a request from the CPU 41 is output to the CPU 41 in a predetermined format. The reception, decipher, computation and output operations are controlled by a control unit 48*a* (microcomputer) provided for the satellite radio wave receiving and processing unit 48.

The respective configurations of the satellite radio wave receiving and processing unit 48 are formed on a chip, as one integrated module, which is connected to the CPU 41. The on and off operations of the satellite radio wave receiving and processing unit 48 are controlled by the CPU 41, independently of the operations of the respective units of the analog electronic timepiece 1. According to the analog electronic timepiece 1, when it is not necessary to operate the satellite radio wave receiving and processing unit 48, the power feeding to the satellite radio wave receiving and processing unit 48 is stopped to save the power.

Also, the satellite radio wave receiving and processing unit 48 has a storage unit. For the storage unit, a non-volatile memory such as a flash memory and an EEPROM (Electrically Erasable and Programmable Read Only Memory) is used, so that the stored contents are kept, irrespective of the power feeding state to the satellite radio wave receiving and processing unit 48. In the storage unit, the time difference map 48*b*, the time difference information 48*c* and the daylight-saving time information 48*d* for acquiring the local time setting information are stored in addition to a variety of operation control programs, predicted orbit information of the respective positioning satellites, which are to be acquired from the positioning satellites, and the setting data such as a leap second correction value. In the meantime, the local time setting information may be stored in the RAM 43 of the analog electronic timepiece 1, and the control unit 48*a* may be configured to receive the information from the CPU 41, as required, or the CPU 41 may be configured to execute the necessary processing. Also, the operation control programs may be stored in a dedicated ROM, read out upon startup and loaded to the RAM of the control unit 48*a*.

The time difference map 48*b* is map data in which a parameter relating to a time zone belonging to each of geographical blocks, which are obtained by dividing a world map into appropriate geographical blocks (geographical positions), and a parameter relating to the daylight-saving time are stored. Although the map of the time difference map 48*b* is not particularly limited, a map in which latitude lines and longitude lines are denoted as linear lines and are drawn to orthogonally intersect is preferably used, and the respective geographical blocks are preferably arranged in a two-dimensional matrix shape at predetermined latitude and longitude intervals. Also, the geographical blocks are configured to have different longitude widths in high and low latitude regions so that actual sizes do not vary greatly between the geographical blocks.

The time difference information 48*c* is table data in which the parameter relating to the time zone, which is used in the time difference map 48*b*, and a time difference in the time zone are associated with each other. In the table data, the parameter is uniquely associated with the time difference in such a way that the time difference corresponding to a parameter '0' is '+0 hour' and the time difference corresponding to a parameter '1' is '+1 hour', for example.

Also, the daylight-saving time information 48*d* is table data in which the parameter relating to the daylight-saving time, which is used in the time difference map 48*b*, and content of the daylight-saving time implementation information (whether the daylight-saving time is to be implemented, the implementation time period and the shift time upon the implementation) are associated with each other. For example, the parameter '0' is associated with 'no implementation of the daylight-saving time', and the parameter '1' is associated with a case where the daylight-saving time is to be implemented from UTC 1:00 AM of last Sunday in March to UTC 1:00 A.M. of last Sunday in October.

In this way, the parameter relating to the time zone and the parameter relating to the daylight-saving time are defined for the same range as one region (predetermined region). Alternatively, even when the contents of the daylight-saving time implementation information are the same, the parameter may be separately set for a different time zone and the parameter relating to the daylight-saving time may be defined for the same range as one region. Also, the region may be determined by the contents of the daylight-saving time implementation information and an administrative unit smaller than the time zone, for example.

The ROM 42 configures the local time information storage unit (the storage unit), and the local time information is configured by the city time difference information 42*b*, the city daylight-saving time information 42*c* and the time difference map 48*b* of the ROM 42 and the time difference information 48*c* and the daylight-saving time information 48*d* of the satellite radio wave receiving and processing unit 48. Also, the city time difference information 42*b* and the time difference information 48*c* have the time zone setting information at each position, and the city daylight-saving time information 42*c* and the daylight-saving time information 48*d* have the daylight-saving time implementation information at each position.

The power supply unit 52 is configured to feed power for operations of the respective units with a predetermined voltage. The power supply unit 52 has a battery. As the battery, a solar panel and a secondary battery are provided, for example. Alternatively, an exchangeable button-type dry cell may be used as the battery. Also, when a plurality of different voltages is output from the power supply unit 52, they can be converted and output into a predetermined voltage by using a switching power supply, for example.

The stepping motor 81 is configured to rotate the second hand 61 through the wheel train mechanism 71, which is an arrangement of toothed wheels. When the stepping motor 81 is driven one time, the second hand 61 is rotated by one step of 6 (six) degrees. The second hand 61 makes one round on the dial plate 3 by 60-times operations of the stepping motor 81.

The stepping motor 82 is configured to rotate the minute hand 62 through the wheel train mechanism 72. When the stepping motor 82 is driven one time, the minute hand 62 is rotated by one step of 1 (one) degree. The minute hand 62 makes one round on the dial plate 3 by 360-times operations of the stepping motor 82.

The stepping motor 83 is configured to rotate the hour hand 63 and the 24-hour hand 64 through the wheel train mechanism 73. The wheel train mechanism 73 is configured to rotate the hour hand 63 and the 24-hour hand 64 in conjunction with each other. When the stepping motor 83 is driven one time, the hour hand 63 is rotated by one step of 1 (one) degree and the 24-hour hand 64 is rotated by a ½ degree. Therefore, when the hour hand 63 and the 24-hour hand 64 are rotated one time per 10 seconds, the hour hand 63 is rotated on the dial plate 3 by 30 degrees and the 24-hour hand 64 is rotated in the small window 4 by 30 degrees in one hour. That is, the hour hand 63 makes one round on the dial plate 3 for 12 hours and the 24-hour hand 64 makes one round in the small window 4 for 24 hours.

The stepping motor 84 is configured to rotate the mode indicator 66 and the date wheel 65 in conjunction with each other through the wheel train mechanism 74. When the stepping motor 84 is driven one time, the mode indicator 66 is rotated by one step of 1 (one) degree. The date wheel 65 is configured to rotate by 360/31 degrees by rotation of 150 steps, for example, so that the date mark to be exposed from the opening 7 is changed by one day. When the date wheel 65 is rotated by degrees corresponding to 31 days, the date mark indicating the first date is again exposed from the opening 7.

The stepping motor 85 is configured to rotate the small minute hand 67 and the small hour hand 68 through the wheel train mechanism 75. When the stepping motor 85 is driven one time, the small minute hand 67 is rotated by one step of 1 (one) degree and the small hour hand 68 is rotated by a 1/12 degree. Therefore, when the stepping motor 85 is driven 360 times, the small minute hand 67 makes one round in the small window 6 and the small hour hand 68 is rotated in the small window 6 by 30 degrees.

Although the time indicators 61 to 63, the 24-hour hand 64, the date wheel 65, the mode indicator 66, the small minute hand 67 and the small hour hand 68 are not particularly limited, they are configured to be rotatable by 90 pps (pulse per second) in a forward rotation direction (clockwise direction) and to be rotatable by 32 pps in a reverse rotation direction.

The indicators 61 to 68 and the stepping motors 81 to 85 configure the display unit.

The driving circuit 51 is configured to output a driving pulse of a predetermined voltage to the stepping motors 81 to 85, in response to the control signal from the CPU 41, thereby rotating the stepping motors 81 to 85 one time by a predetermined angle (for example, 180 degrees). The driving circuit 51 can vary a length (pulse width) of the driving pulse, depending on a state of the analog electronic timepiece 1, for example. Also, when a control signal for driving the plurality of indicators at the same time is input, the output timings of the driving pulse may be made to be different so as to reduce the load.

In the below, the local time setting operation in the analog electronic timepiece 1 of the illustrative embodiment is described.

In the analog electronic timepiece 1, the local time is manually or automatically set. When manually setting the local time, the setting and computation of the local time corresponding to the city selected by the user are performed by referring to the city time difference information 42*b* and the city daylight-saving time information 42*c*. On the other hand, when automatically setting the local time, the setting and computation of the local time corresponding to the current position obtained by a navigation message acquired from a positioning satellite are performed by referring to the time difference map 48*b*, the time difference information 48*c* and the daylight-saving time information 48*d*. In addition, the settings stored in the city time difference information 42*b*, the city daylight-saving time information 42*c* and the time difference map 48*b* can be corrected by a user's correction operation and can be stored and used as the city user correction data 43*a* and the map user correction data 43*b*.

Also, according to the analog electronic timepiece 1, the user can select any one of a display setting DST (AUTO) for automatically displaying the daylight-saving time in accordance with the daylight-saving time implementation information relating to the selected local time setting information, a display setting (STD) for disabling the display of the daylight-saving time, irrespective of the daylight-saving time implementation information relating to the set local time setting information, and a display setting (DST) for displaying the daylight-saving time with a deviation of the set shift time (for example, 1 hour), irrespective of the daylight-saving time implementation information.

Figure 3A:
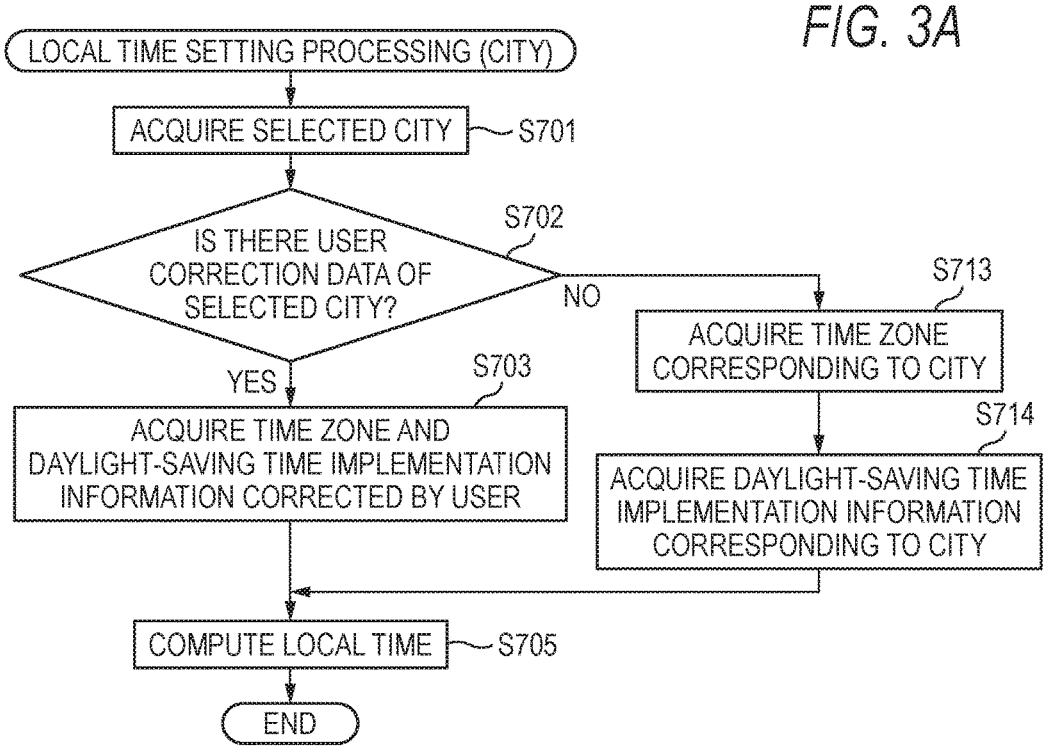
FIGS. 3A and 3B are flowcharts depicting local time setting processing in the analog electronic timepiece of the illustrative embodiment.

FIG. 3 is a flowchart depicting a control sequence of local time setting processing in the analog electronic timepiece 1 of the illustrative embodiment, which is to be executed by the CPU 41. FIG. 3A depicts a control sequence of the local time setting processing, which is to be executed when the user manually selects and sets a city. Here, the user pulls out the stem C1 in two steps, so that the mode proceeds to a city setting mode. Also, the user rotates the stem C1 to indicate any one of the cities described at the peripheral edge portion of the dial plate 3 by the second hand 61 and selects the corresponding city.

The CPU 41 acquires a city selected by the user (step S701). The CPU 41 determines whether the user correction data corresponding to the city is stored in the city user correction data 43*a* (step S702). When it is determined that the user correction data is stored ("YES" in step S702), the CPU 41 acquires the time difference information and daylight-saving time implementation information corresponding to the city by referring to the city user correction data 43*a* (step S703). Then, the processing of the CPU 41 proceeds to step S705.

When it is determined that the user correction data corresponding to the selected city is not stored in the city user correction data 43*a* ("NO" in step S702), the CPU 41 acquires the time zone corresponding to the city by referring to the city time difference information 42*b* (step S713) and also acquires the daylight-saving time implementation information corresponding to the city by referring to the city daylight-saving time information 42*c* (step S714). At this time, when the user correction data relating to the local time setting information of a city different from the selected city is stored in the city user correction data 43*a*, the CPU 41 may delete the corresponding user correction data. Also, even when the user correction data of which the effective period has elapsed, the CPU 41 may also delete the corresponding user correction data. Then, the processing of the CPU 41 proceeds to step S705.

When the processing proceeds to step S705, the CPU 41 computes date and time of local time by applying the acquired time zone and daylight-saving time to the date and time counted by the timer circuit 46 (step S705). Then, the CPU 41 ends the local time computation processing.

Figure 3B:
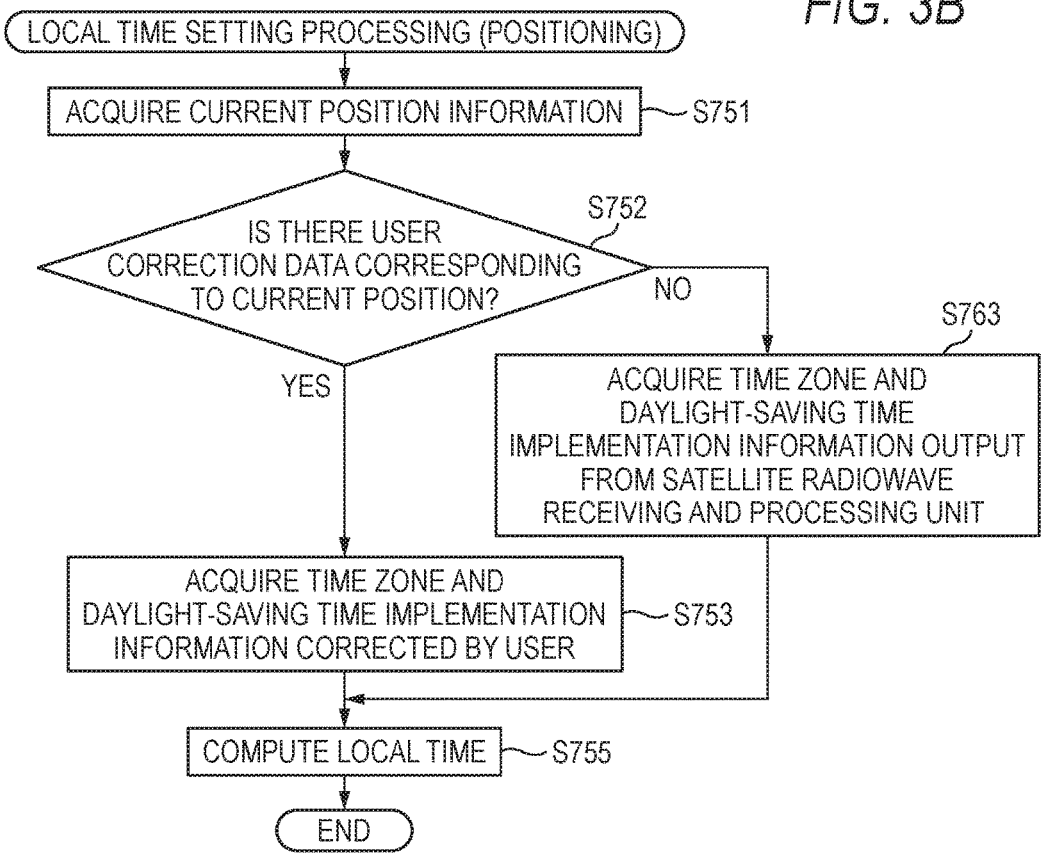

FIG. 3B depicts a control sequence of the local time setting processing, which is to be executed when the positioning is performed by the satellite radio wave receiving and processing unit 48. Here, the radio waves from the positioning satellites are received at the satellite radio wave receiving and processing unit 48, the current position is computed using the received navigation messages and the computation result is output to the CPU 41, so that the current position is acquired.

At this time, the control unit 48*a* of the satellite radio wave receiving and processing unit 48 acquires the parameter relating to the time zone corresponding to the computed current position and the parameter relating to the daylight-saving time by referring to the time difference map 48*b*. The control unit 48*a* acquires the time difference (shift time from UTC) corresponding to the parameter relating to the time zone by referring to the time difference information 48*c*, and also acquires the daylight-saving time implementation information corresponding to the parameter relating to the daylight-saving time, i.e., the information as to whether the daylight-saving time is to be implemented, the implementation time period of the daylight-saving time and the shift time from the standard time during the implementation time period of the daylight-saving time by referring to the daylight-saving time information 48*d*. Then, the control unit 48*a* outputs the time zone and the daylight-saving time implementation information to the CPU 41, together with the acquired current position.

The CPU 41 acquires the current position from the satellite radio wave receiving and processing unit 48 (step S751). The CPU 41 determines whether the user correction data corresponding to the current position (i.e., the user correction data in the region including the current position) is stored in the map user correction data 43*b* (step S752).

When it is determined that the corresponding user correction data is stored in the map user correction data 43*b* ("YES" in step S75), the CPU 41 acquires the time zone and the daylight-saving time implementation information by referring to the map user correction data 43*b* (step S753). Then, the processing of the CPU 41 proceeds to step S755.

When it is determined that the corresponding user correction data is not stored in the map user correction data 43*b* ("NO" in step S752), the CPU 41 acquires the time zone and the daylight-saving time implementation information output from the satellite radio wave receiving and processing unit 48 (step S763). At this time, when the user correction data, which does not correspond to the current position, is stored in the map user correction data 43*b*, the CPU 41 may delete the corresponding user correction data. Also, even when the user correction data of which the effective period has elapsed is stored, the CPU 41 deletes the corresponding user correction data. Then, the processing of the CPU 41 proceeds to step S755.

When the processing proceeds to step S755, the CPU 41 sets the local time at the current position by applying the acquired time zone and daylight-saving time implementation information (step S755). That is, the CPU 41 computes a time difference at the current UTC date and time (when the implementation of the daylight-saving time is switched based on the local time, the local time is tentatively computed once based on the time zone and it is determined whether the daylight-saving time is implemented), based on the selected and acquired local time setting information. The CPU 41 computes the local time by applying the time difference to the date and time counted with the timer circuit 46, and outputs a control signal to the driving circuit 51 to enable some of the indicators 61 to 68 to display the local time. Then, the CPU 41 ends the local time setting processing.

Subsequently, an input setting operation of the correction data of the time zone and the daylight-saving time information, which is to be performed by the user, is described.

Figure 4:
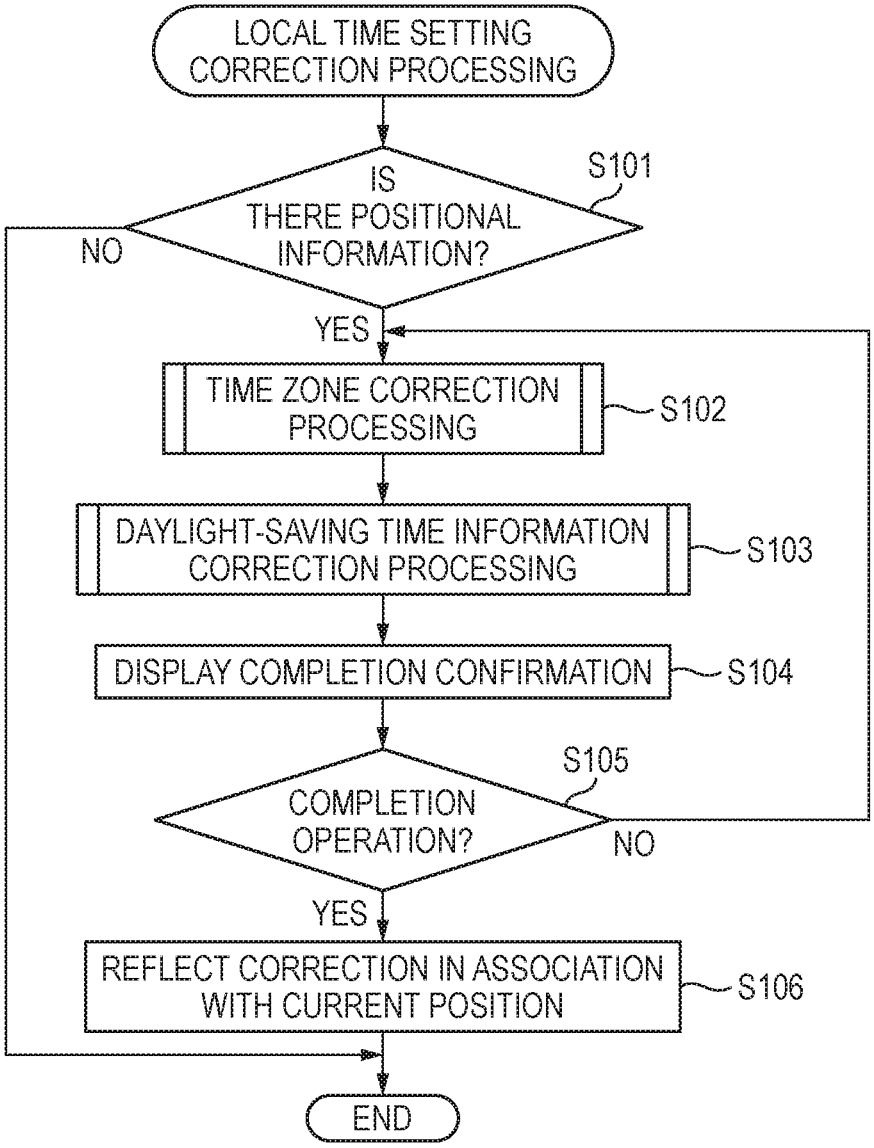
FIG. 4 is a flowchart depicting a control sequence of local time setting correction processing.
Figure 5:
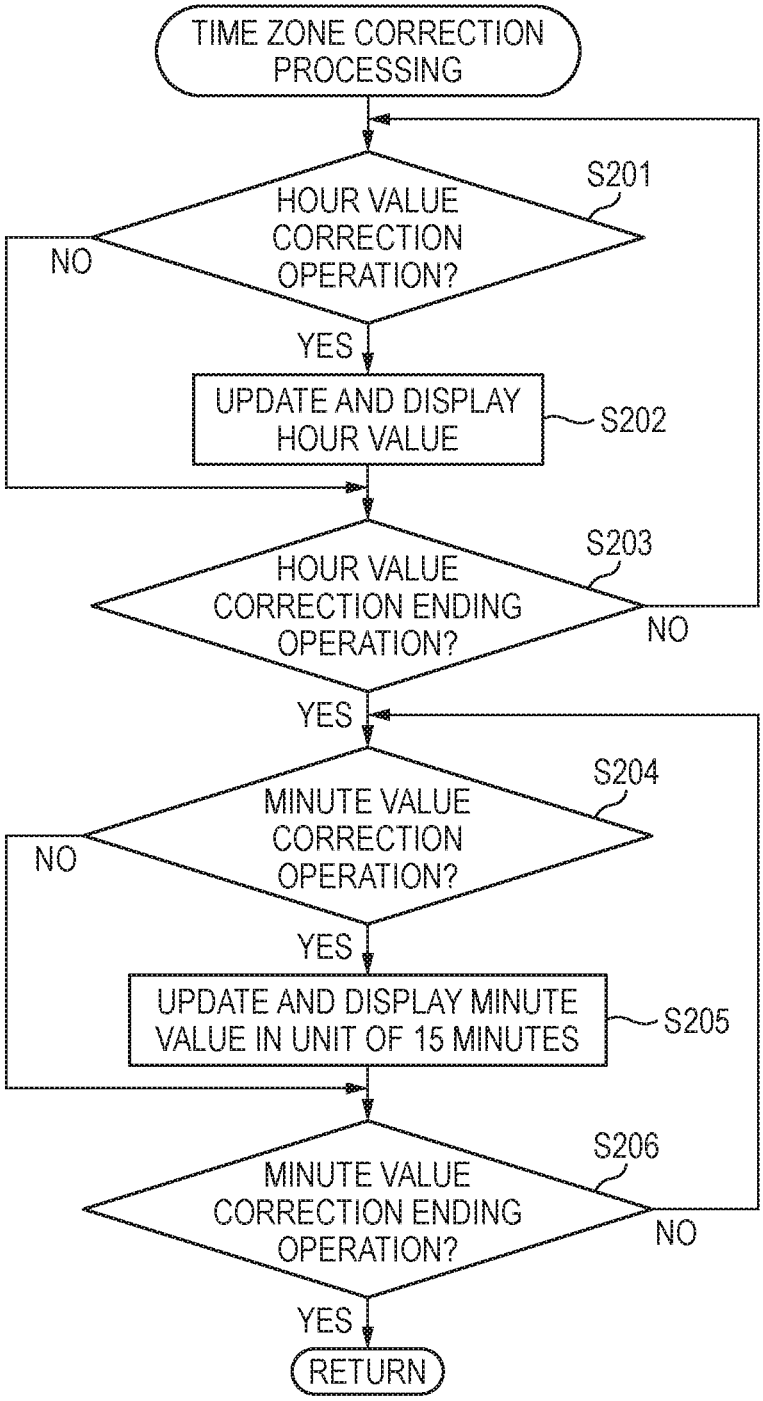
FIG. 5 is a flowchart depicting a control sequence of time zone correction processing that is to be called in the local time setting correction processing.

FIG. 4 is a flowchart depicting a control sequence of local time setting correction processing, which is to be executed in the analog electronic timepiece 1 of the illustrative embodiment by the CPU 41.

The local time setting correction processing starts when a specific user operation, for example, the push-button switch B3 is additionally pushed for 10 seconds at a state where the stem C1 is pulled out in two steps.

When the local time setting correction processing starts, the CPU 41 determines whether the positional information (the latitude, the longitude) or the city setting relating to the current position, which is a target position for which the local time setting information is to be corrected, is kept (step S101). When it is determined that the positional information or the city setting is not kept ("NO" in step S101), the CPU 41 ends the local time setting correction processing.

When it is determined that the positional information or the city setting is kept ("YES" in step S101), the CPU 41 executes correction processing of the time zone setting (step S102). Also, the CPU 41 executes correction processing of the setting relating to the daylight-saving time implementation information (step S103).

The CPU 41 outputs a control signal to the driving circuit 51 to move a necessary one of the indicators 61 to 68 and to confirm whether to complete the setting with the correction by displaying a correction result (step S104). The CPU 41 determines whether a setting completion operation is input (step S105). When it is determined that a setting completion operation, here, an operation of pushing the stem C1 back in one step or more is performed ("YES" in step S105), the CPU 41 associates the city setting and the correction setting and stores the same in the city user correction data 43*a* or associates the current position (or a region including the current position) and the correction setting and stores the same in the map user correction data 43*b* (step S106). At this time, when the correction data of the same city or the same region as the current position is stored, the CPU 41 overwrites the previous correction data by the new setting and stores the same. Then, the CPU 41 ends the local time setting correction processing.

When it is determined that an operation rather than the setting completion operation is performed ("NO" in step S105), the CPU 41 returns to step S102 and again performs the processing relating to the setting.

FIG. 4 is a flowchart depicting a control sequence of time zone correction processing, which is to be called in the local time setting correction processing and is to be executed by the CPU 41.

When the time zone correction processing is called, the CPU 41 outputs a control signal to the driving circuit 51 to rotate the indicator (the second hand 61) so as to indicate the city mark corresponding to the currently set time zone, and then stands by for a correction operation of an hour value. Then, the CPU 41 determines whether a correction operation of an hour value, here, a rotating operation of the stem C1 is detected (step S201). When it is determined that the correction operation is detected ("YES" in step S201), the CPU 41 updates an hour value by ±1 hour in correspondence to the rotation direction of the stem C1, and outputs a control signal to the driving circuit 51 to enable the indicator (here, the second hand 61) to indicate a city mark corresponding to the updated value (step S202). Then, the processing of the CPU 41 proceeds to step S203. In the determination processing of step S201, when it is determined that the correction operation of the hour value is not detected ("NO" in step S201), the processing of the CPU 41 proceeds to step S203.

In the processing of step S203, the CPU 41 determines whether an operation of ending the correction operation of the hour value, for example, the pushing operation of the push-button switch B3 is detected (step S203). When it is determined that the ending operation is not performed (NO" in step S203), the processing of the CPU 41 returns to step S201.

When it is determined that the ending operation is performed ("YES" in step S203), the CPU 41 outputs a control signal to the driving circuit 51 to enable the second hand 61 to indicate a minute value of the time difference from the UTC time in the currently set time zone. Then, the CPU 41 determines whether a correction operation of the minute value, here, the rotating operation of the stem C1 is detected (step S204). When it is determined that the correction operation of the minute value is detected ("YES" in step S204), the CPU 41 updates the minute value in correspondence to the rotation direction of the stem C1, and outputs a control signal to the driving circuit 51 to enable the indicator (here, the second hand 61) to indicate the updated value (step S205). Here, the time difference from the UTC time is just set in a 15-minute unit in various regions of the world. Therefore, the analog electronic timepiece 1 may be configured to update the minute value by 15 minutes whenever the stem C1 is rotated by one step. Then, the processing of the CPU 41 proceeds to step S206.

When it is determined that the correction operation of the minute value is not detected ("NO" in step S204), the CPU 41 proceeds to step S206.

When the processing proceeds to step S206, the CPU 41 determines whether an operation of ending the correction operation of the minute value, for example, the pushing operation of the push-button switch B3 is detected (step S206). When it is determined that the ending operation is performed ("YES" in step S206), the CPU 41 ends the time zone correction processing, and returns to the local time setting ending processing. When it is determined that the ending operation is not performed ("NO" in step S206), the processing of the CPU 41 returns to step S204.

Figure 6:
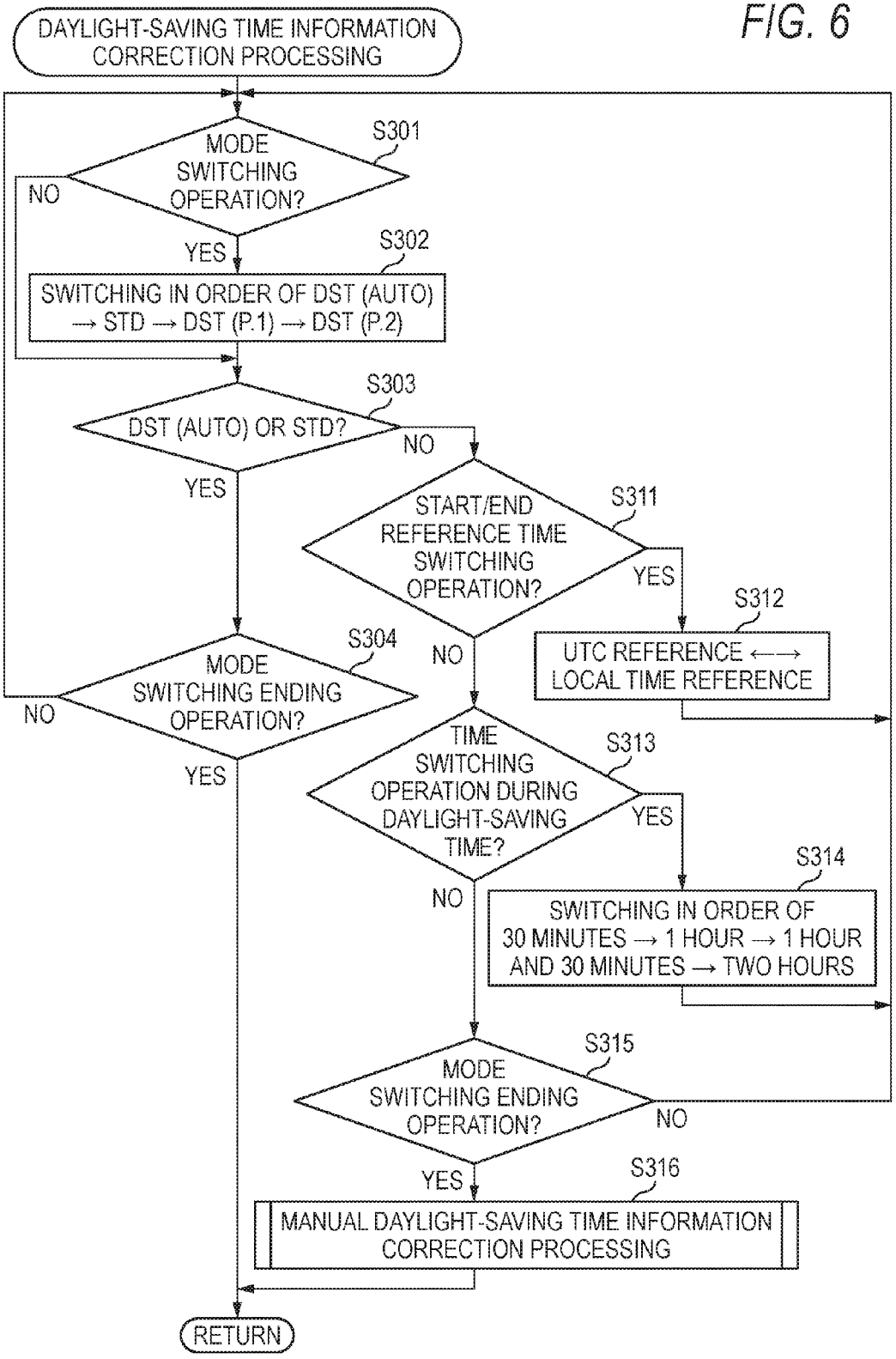
FIG. 6 is a flowchart depicting a control sequence of daylight-saving time information correction processing that is to be called in the local time setting correction processing.

FIG. 6 is a flowchart depicting a control sequence of daylight-saving time information correction processing, which is to be called in the local time setting correction processing and is to be executed by the CPU 41.

When the daylight-saving time information correction processing is called, the CPU 41 outputs a control signal to the driving circuit 51 to enable the mode indicator 66 to indicate a mark relating to the setting mode of the currently set daylight-saving time. Then, the CPU 41 determines whether a switching operation of the setting mode of the daylight-saving time, for example, the pushing operation of the push-button switch B4 is performed (step S301). When it is determined that the switching operation is performed ("YES" in step S301), the CPU 41 changes the setting to a next setting mode of the setting mode of the currently set daylight-saving time, and outputs a control signal to the driving circuit 51 to update the display state conforming to the setting, here, the position indicated by the mode indicator 66 (step S302). The setting mode is switched in order of the automatic implementation mode DST (AUTO) of the daylight-saving time, the non-implementation mode of the daylight-saving time (STD), a manual setting mode pattern 1 (P.1) of the daylight-saving time and a manual setting mode pattern 2 (P.2) of the daylight-saving time, and is again returned to the automatic implementation mode when the operation is performed with the manual setting mode pattern 2 (P.2). Then, the processing of the CPU 41 proceeds to step S303. When it is determined that the switching operation is not performed ("NO" in step S301), the processing of the CPU 41 proceeds to step S303.

When the processing proceeds to step S303, the CPU 41 determines whether the current setting mode is one of DST (AUTO) and STD (step S303). When it is determined that the current setting mode is one of DST (AUTO) and STD ("YES" in step S303), the CPU 41 determines whether an ending operation of the mode switching is performed (step S304). When it is determined that the ending operation of the mode switching, for example, the push-button switch B3 is pushed ("YES" in step S304), the CPU 41 ends the daylight-saving time information correction processing and returns to the local time setting correction processing. When it is determined that the ending operation of the mode switching is not performed ("NO" in step S304), the processing of the CPU 41 returns to step S301.

When it is determined in the determination processing of step S303 that the current setting mode is not DST (AUTO) or STD (i.e., the current setting mode is the manual setting mode pattern (P. 1 or P. 2)) ("NO" in step S303), the CPU 41 determines whether a reference time switching operation of the start time and end time of the daylight-saving time, here, for example, the pushing operation of the push-button switch B1 is detected (step S311). When it is determined that the reference time switching operation is detected ("YES" in step S311), the CPU 41 switches the reference time between a UTC time reference and a local time reference, displays the current setting and outputs a control signal to the driving circuit 51, and moves the indicator (the second hand 61) between a mark position (12 o'clock position) of the UTC and a mark position corresponding to the set time zone to display the current reference time (step S312). Then, the processing of the CPU 41 returns to step S301.

When it is determined that the reference time switching operation is not detected ("NO" in step S311), the CPU 41 determines whether a switching operation of the shift time upon the implementation of the daylight-saving time, here, the rotating operation of the stem C1 is detected (step S313). When it is determined that the switching operation of the shift time is detected ("YES" in step S313), the CPU 41 increases or decreases the shift time in a 30-minute unit in correspondence to the rotation direction of the stem C1, for example, and enables the indicator (the minute hand 62 and the hour hand 63) to indicate the increased or decreased shift time (step S314). Then, the processing of the CPU 41 returns to step S301.

When it is determined that the switching operation of the shift time is not detected ("NO" in step S313), the CPU 41 determines whether an ending operation of the mode switching (the pushing operation of the push-button switch B3) is detected (step S315). When it is determined that the ending operation of the mode switching is not detected ("NO" in step S315), the processing of the CPU 41 returns to step S301. When it is determined that the ending operation of the mode switching is detected ("YES" in step S315), the CPU 41 calls and executes the manual daylight-saving time information correction processing (step S316), ends the daylight-saving time information correction processing and returns to the local time setting correction processing.

Figure 7:
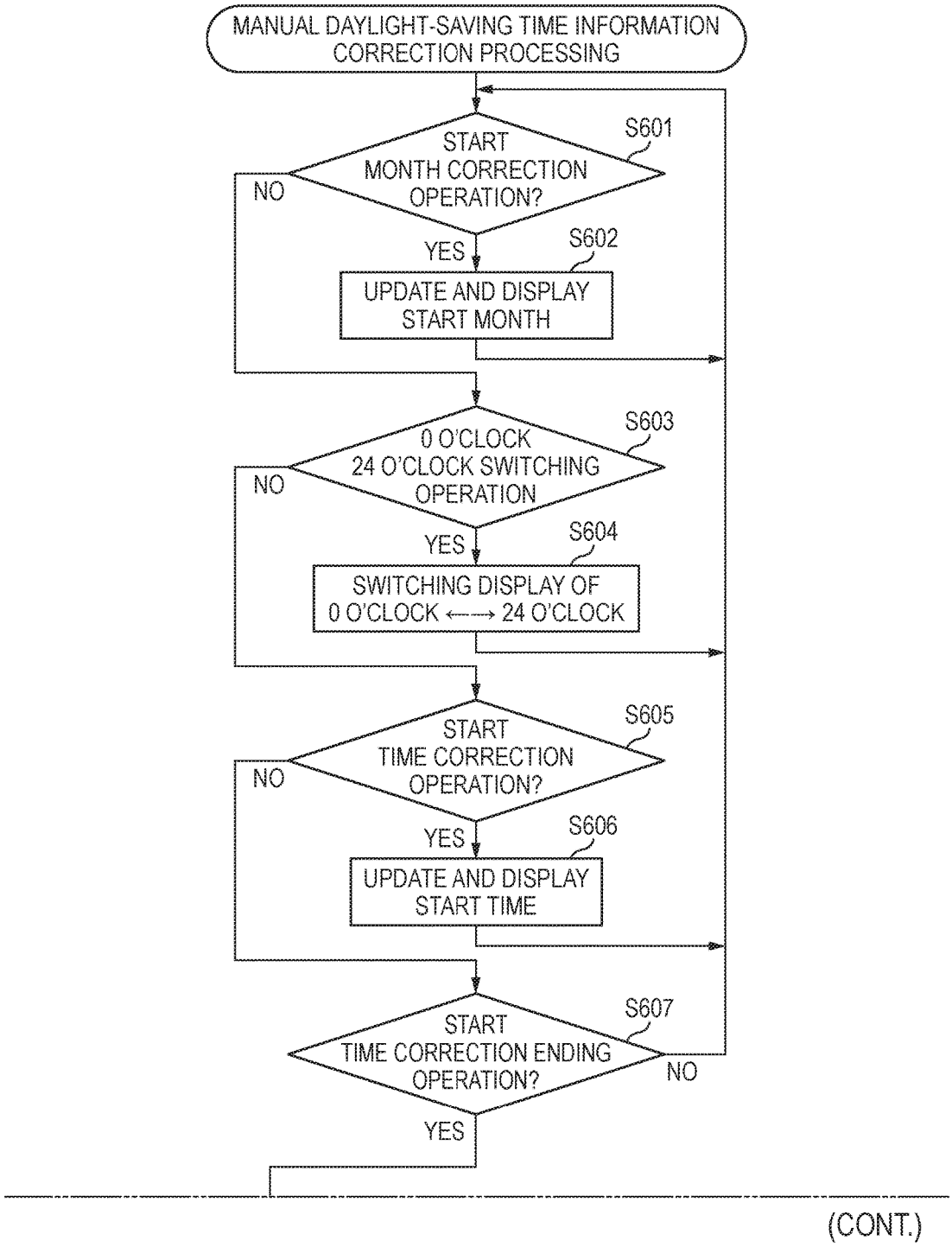
FIG. 7 is a flowchart depicting a control sequence of manual daylight-saving time information correction processing that is to be called in the daylight-saving time information correction processing.
Figure 8:
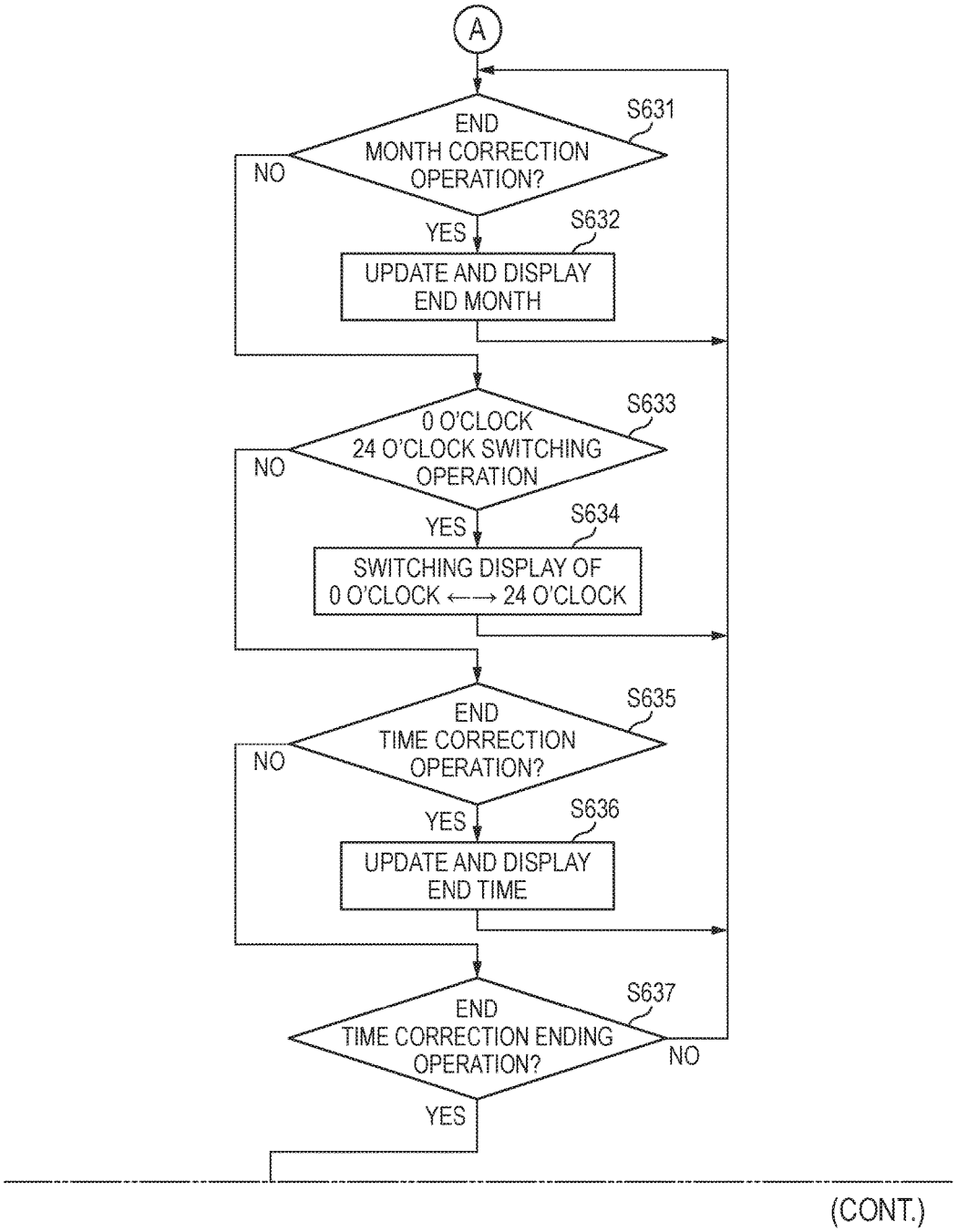
FIG. 8 is a flowchart depicting a control sequence of the manual daylight-saving time information correction processing that is to be called in the daylight-saving time information correction processing.

FIGS. 7 and 8 are flowcharts depicting a control sequence of manual daylight-saving time information correction processing, which is to be called in the daylight-saving time information correction processing and is to be executed by the CPU 41.

When the daylight-saving time information correction processing is called, the CPU 41 outputs a control signal to the driving circuit 51, enables the small minute hand 67 and the small hour hand 68 to indicate 'one o'clock', thereby displaying a setting state of a start month and start time of the daylight-saving time. Also, the CPU 41 displays a start month (for example, the second hand 61) and start time (for example, the hour hand 63 and the minute hand 62) of the currently set daylight-saving time, and then determines whether a correction operation of the start month of the daylight-saving time, for example, the pushing operation of the push-button switch B1 is detected (step S601). When it is determined that the correction operation of the start month is detected ("YES" in step S601), the CPU 41 puts forward the start month by one month, outputs a control signal to the driving circuit 51, and enables the indicator (the second hand 61) to indicate a position indicating a mark corresponding to the put forward month (step S602). Then, the processing of the CPU 41 returns to step S601.

When it is determined that the correction operation of the start month is not detected ("NO" in step S601), the CPU 41 determines whether a switching operation as to whether the 'midnight setting' relating to the start time is 0 o'clock (first at that day) or 24 o'clock (last at that day), for example, the pushing operation of the push-button switch B4 is detected (step S603). When it is determined that the switching operation is detected ("YES" in step S603), the CPU 41 alternately switches the setting between 0 o'clock and 24 o'clock, outputs a control signal to the driving circuit 51, and moves the mode indicator 66 to a corresponding position, for example, between a 0 o'clock position and a 6 o'clock position (step S604). Then, the processing of the CPU 41 returns to step S601.

When it is determined that the switching operation of 0 o'clock and 24 o'clock is not detected ("NO" in step S603), the CPU 41 determines whether a correction operation of the start time, for example, the rotating operation of the stem C1 is detected (step S605). When it is determined that the correction operation of the start time is detected ("YES" in step S605), the CPU 41 changes the start time by ±1 hour in correspondence to the rotation direction of the stem C1, outputs a control signal to the driving circuit 51, and moves the minute hand 62 and the hour hand 63 to the indicator positions corresponding to the changed start time (step S606). Then, the processing of the CPU 41 returns to step S601.

When it is determined that the correction operation of the start time is not detected ("NO" in step S605), the CPU 41 determines whether an operation of ending the correction operation of the start month and start time of the daylight-saving time, for example, the pushing operation of the push-button switch B3 is detected (step S606). When it is determined that the ending operation of the correction operation is not detected ("NO" in step S606), the processing of the CPU 41 returns to step S601.

When it is determined that the operation of ending the correction operation of the start month and start time of the daylight-saving time is detected ("YES" in step S606), the CPU 41 determines whether the mode setting of the daylight-saving time is the manual mode pattern 1 (P.1) (step S607). When it is determined that the mode setting is the manual mode pattern 1 (P.1) ("YES" in step S607), the CPU 41 proceeds to a correction state of the start date of the daylight-saving time, outputs a control signal to the driving circuit 51, and moves the small minute hand 67 and the small hour hand 68 so as to indicate a 2 o'clock position, thereby displaying the correction state of the start date of the daylight-saving time. Also, the CPU 41 enables the second hand 61 (what week number) and the mode indicator 66 (a day of week) to set a start date of the currently set daylight-saving time. Then, the CPU 41 determines whether a correction operation of the start week, for example, the pushing operation of the push-button switch B1 is detected (step S611). When it is determined that the correction operation of the start week is detected ("YES" in step S611), the CPU 41 sequentially changes the start week between a first week and a fourth week or a final week, outputs a control signal to the driving circuit 51, and changes a position indicated by the second hand 61 (step S612). Then, the processing of the CPU 41 returns to step S611.

When it is determined that the correction operation of the start week is not detected ("NO" in step S611), the CPU 41 determines whether a correction operation of the start day, for example, the pushing operation of the push-button switch B4 is detected (step S613). When it is determined that the correction operation of the start day is detected ("YES" in step S613), the CPU 41 sequentially changes the start day between Sunday and Saturday, outputs a control signal to the driving circuit 51 and enables the mode indicator 66 to indicate a mark relating to the changed day (step S614). Then, the processing of the CPU 41 returns to step S611.

When it is determined that the correction operation of the start day is not detected ("NO" in step S613), the CPU 41 determines whether an operation of ending the correction operation of the start date, for example, the pushing operation of the push-button switch B3 is detected (step S615). When it is determined that the operation of ending the correction operation of the start date is not detected ("NO" in step S615), the processing of the CPU 41 returns to step S611. When it is determined that the operation of ending the correction operation of the start date is detected ("YES" in step S615), the processing of the CPU 41 proceeds to step S631.

When it is determined in the determination processing of step S608 that the mode setting is not the manual mode pattern 1 (P.1) (i.e., the mode setting is the manual mode pattern 2 (P. 2)) ("NO" in step S608), the CPU 41 proceeds to the correction state of the start date of the daylight-saving time, outputs a control signal to the driving circuit 51, and moves the small minute hand 67 and the small hour hand 68 so as to indicate a 2 o'clock position, thereby displaying the correction state of the start date of the daylight-saving time. Also, the CPU 41 enables the date wheel 65 to set the start date of the currently set daylight-saving time. Then, the CPU 41 determines whether a correction operation of the start date, for example, the rotating operation of the stem C1 is detected (step S621).

When it is determined that the correction operation of the start date is detected ("YES" in step S621), the CPU 41 changes the start date by ±1 day in correspondence to the rotation direction of the stem C1, and outputs a control signal the driving circuit 51 to rotate the date wheel 65, thereby displaying the changed start date (step S622). Then, the processing of the CPU 41 returns to step S621.

When it is determined that the correction operation of the start date is not detected ("NO" in step S621), the CPU 41 determines whether an operation of ending the correction operation of the start date, for example, the pushing operation of the push-button switch B3 is detected (step S623). When it is determined that the operation of ending the correction operation of the start date is not detected ("NO" in step S623), the CPU 41 returns to step S621. When it is determined that the operation of ending the correction operation of the start date is detected ("YES" in step S623), the processing of the CPU 41 proceeds to step S631.

When the processing proceeds to step S631, the CPU 41 outputs a control signal to the driving circuit 51, enables the small minute hand 67 and the small hour hand 68 to indicate '3 o'clock', thereby displaying the setting state of the end month and end time of the daylight-saving time. Also, the CPU 41 displays the end month (for example, the second hand 61) and the end time (for example, the hour hand 63 and the minute hand 62) of the currently set daylight-saving time, and then determines whether a correction operation of the end month of the daylight-saving time, for example, the pushing operation of the push-button switch B1 is detected (step S631). When it is determined that the correction operation of the end month is detected ("YES" in step S631), the CPU 41 puts forward the end month by one month, outputs a control signal to the driving circuit 51, and enables the indicator (the second hand 61) to indicate a mark corresponding to the put forward month (step S632). Then, the processing of the CPU 41 returns to step S631.

When it is determined that the correction operation of the end month is not detected ("NO" in step S631), the CPU 41 determines whether a switching operation as to whether the 'midnight setting' relating to the end time is 0 o'clock (first at that day) or 24 o'clock (last at that day), for example, the pushing operation of the push-button switch B4 is detected (step S633). When it is determined that the switching operation is detected ("YES" in step S633), the CPU 41 alternately switches the setting between 0 o'clock and 24 o'clock, outputs a control signal to the driving circuit 51, and moves the mode indicator 66 to a corresponding position, for example, one of a 0 o'clock position and a 6 o'clock position (step S634). Then, the processing of the CPU 41 returns to step S631.

When it is determined that the switching operation of 0 o'clock and 24 o'clock is not detected ("NO" in step S633), the CPU 41 determines whether a correction operation of the end time, for example, the rotating operation of the stem C1 is detected (step S635). When it is determined that the correction operation of the end time is detected ("YES" in step S635), the CPU 41 changes the end time by ±1 hour in correspondence to the rotation direction of the stem C1, outputs a control signal to the driving circuit 51, and moves the minute hand 62 and the hour hand 63 to the indicator positions corresponding to the changed end time (step S636). Then, the processing of the CPU 41 returns to step S631.

When it is determined that the correction operation of the end time is not detected ("NO" in step S635), the CPU 41 determines whether an operation of ending the correction operation of the end month and end time of the daylight-saving time, for example, the pushing operation of the push-button switch B3 is detected (step S636). When it is determined that the ending operation of the correction operation is not detected ("NO" in step S636), the processing of the CPU 41 returns to step S631.

When it is determined that the operation of ending the correction operation of the end month and end time of the daylight-saving time is detected ("YES" in step S636), the CPU 41 determines whether the mode setting of the daylight-saving time is the manual mode pattern 1 (P.1) (step S637). When it is determined that the mode setting is the manual mode pattern 1 (P.1) ("YES" in step S637), the CPU 41 proceeds to the correction state of the end date of the daylight-saving time, outputs a control signal to the driving circuit 51, and moves the small minute hand 67 and the small hour hand 68 so as to indicate a 4 o'clock position, thereby displaying the correction state of the end date of the daylight-saving time. Also, the CPU 41 enables the second hand 61 (what week number) and the mode indicator 66 (a day of week) to set an end date of the currently set daylight-saving time. Then, the CPU 41 determines whether a correction operation of the end week, for example, the pushing operation of the push-button switch B1 is detected (step S641). When it is determined that the correction operation of the end week is detected ("YES" in step S641), the CPU 41 sequentially changes the start week between a first week and a fourth week or a final week, outputs a control signal to the driving circuit 51, and changes a position indicated by the second hand 61 (step S642). Then, the processing of the CPU 41 returns to step S641.

When it is determined that the correction operation of the end week is not detected ("NO" in step S641), the CPU 41 determines whether a correction operation of the end day, for example, the pushing operation of the push-button switch B4 is detected (step S643). When it is determined that the correction operation of the end day is detected ("YES" in step S643), the CPU 41 sequentially changes the end day between Sunday and Saturday, output a control signal to the driving circuit 51 and enables the mode indicator 66 to indicate a mark relating to the changed day (step S644). Then, the processing of the CPU 41 returns to step S641.

When it is determined that the correction operation of the end day is not detected ("NO" in step S643), the CPU 41 determines whether an operation of ending the correction operation of the end date, for example, the pushing operation of the push-button switch B3 is detected (step S645). When it is determined that the operation of ending the correction operation of the end date is not detected ("NO" in step S645), the processing of the CPU 41 returns to step S641. When it is determined that the operation of ending the correction operation of the end date is detected ("YES" in step S645), the CPU 41 ends the manual daylight-saving time information correction processing and returns to the daylight-saving time information correction processing.

When it is determined in the determination processing of step S638 that the mode setting is not the manual mode pattern 1 (P.1) (i.e., the mode setting is the manual mode pattern 2 (P. 2)) ("NO" in step S638), the CPU 41 proceeds to the correction state of the end date of the daylight-saving time, outputs a control signal to the driving circuit 51, and moves the small minute hand 67 and the small hour hand 68 so as to indicate a 4 o'clock position, thereby displaying the correction state of the end date of the daylight-saving time. Also, the CPU 41 enables the date wheel 65 to set the end date of the currently set daylight-saving time. Then, the CPU 41 determines whether a correction operation of the end date, for example, the rotating operation of the stem C1 is detected (step S651).

When it is determined that the correction operation of the end date is detected ("YES" in step S651), the CPU 41 changes the end date by ±1 day in correspondence to the rotation direction of the stem C1, and outputs a control signal the driving circuit 51 to rotate the date wheel 65, thereby displaying the changed end date (step S652). Then, the processing of the CPU 41 returns to step S651.

When it is determined that the correction operation of the end date is not detected ("NO" in step S651), the CPU 41 determines whether an operation of ending the correction operation of the end date, for example, the pushing operation of the push-button switch B3 is detected (step S653). When it is determined that the operation of ending the correction operation of the end date is not detected ("NO" in step S653), the CPU 41 returns to step S651. When it is determined that the operation of ending the correction operation of the end date is detected ("YES" in step S653), the CPU 41 ends the manual daylight-saving time information correction processing and returns to the daylight-saving time information correction processing.

FIGS. 9 to 11 depict display examples, which are to be displayed upon execution of the local time setting correction processing in the analog electronic timepiece 1 of the illustrative embodiment.

Figure 9A:
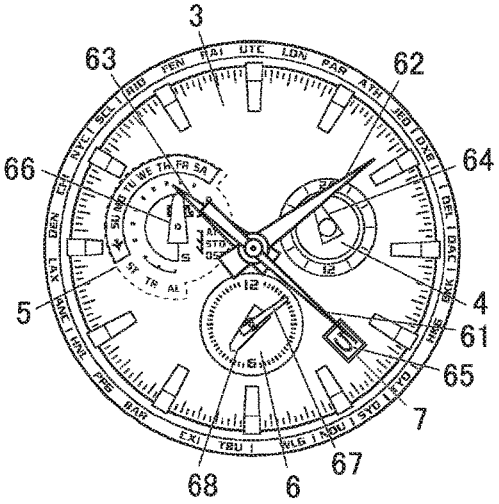
FIGS. 9A, 9B, 9C and 9D depict an example of correction by the local time setting correction processing.
Figure 10A:
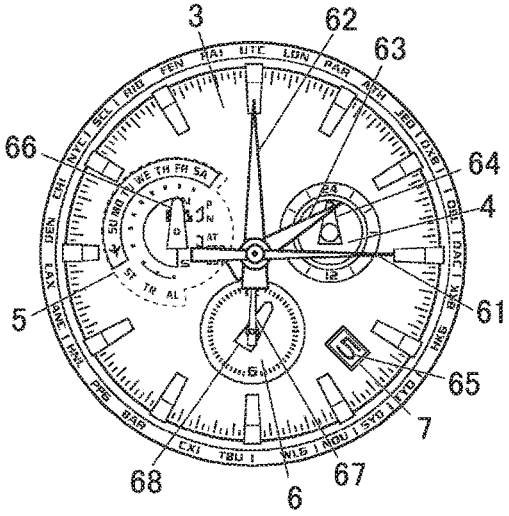
FIGS. 10A, 10B and 10C depict an example of correction by the local time setting correction processing.

When the local time setting correction processing starts, a mark relating to a city corresponding to the hour value in the current time zone is indicated by the second hand 61 (step S101). Here, the city mark 'TYO', i.e., '+9 hours', which is the time difference of Tokyo, is indicated by the second hand 61 (FIG. 9A). At this state, when the stem C1 is rotated, the second hand 61 is moved to a position of a city mark of which the time zone is different by one hour whenever the stem C1 is rotated by one step (steps S201, S202). That is, here, a position of a city mark of which the time difference includes a value of a minute unit (+5 hours and 30 minutes) such as New Delhi indicated by the city mark 'DEL' is skipped.

Figure 9B:
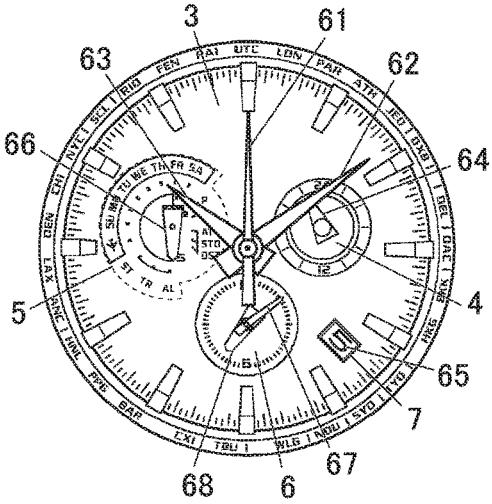

When the push-button switch B3 is pushed and the correction operation of the hour value of the time zone is thus over (step S203), the second hand 61 indicates a position of 0 minute, so that the minute value included in the time difference from the UTC time at the current position is displayed (FIG. 9B). At this state, when the stem C1 is rotated, the minute value is changed by 15 minutes whenever the stem C1 is rotated by one step, and the second hand 61 is moved by 15 seconds (steps S204, S205).

Figure 9C:
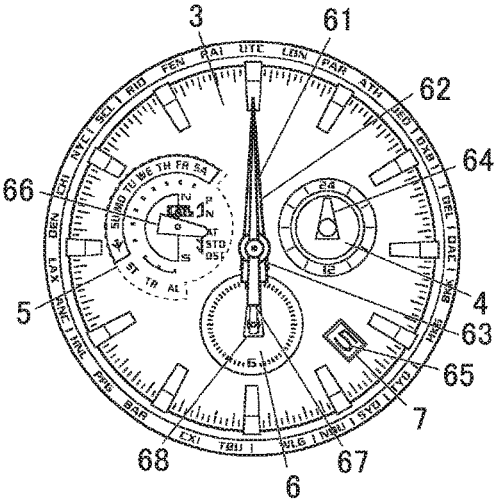

When the push-button switch B3 is pushed and the correction operation of the minute value of the time zone is thus over (step S206), all the time indicators 61 to 63 are arranged in the 12 o'clock direction, and the mode indicator 66 indicates any one of the marks relating to the daylight-saving time setting in the region 5. Here, the mode indicator 66 indicates the mark 'AT' indicating DST (AUTO) (FIG. 9C).

Here, whenever the push-button switch B4 is pushed, the mode indicator 66 sequentially moves from the position of the mark 'AT' to the respective positions of 'STD' and 'DST' and the position more advanced than the position of 'DST' in the clockwise direction by a predetermined angle (steps S301, S302). As described above, the manual setting of the daylight-saving time includes the pattern 1 relating to the day setting and the pattern 2 relating to the date setting. Here, the position of 'DST' indicates the pattern 1, and the position more advanced than the position of 'DST' in the forward rotation direction indicates the pattern 2.

Figure 9D:
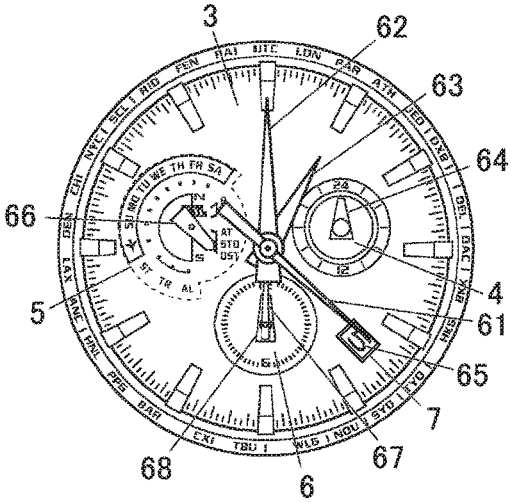

As shown in FIG. 9D, at the state of the pattern 1, the shift time during the implementation time period of the daylight-saving time is indicated by the minute hand 62 and the hour hand 63, and the switching reference time is indicated by the second hand 61 (step S303). Here, the hour hand 63 indicates the 1 o'clock direction and the minute hand 62 indicates the 12 o'clock (0 minute) direction, thereby indicating that the shift time is one hour. Also, the second hand 61 indicates the city mark 'TYO', thereby indicating the setting that the start and end timings of the daylight-saving time are defined based on the local time of Tokyo. At this state, when the push-button switch B1 is pushed (step S311), the switching reference time is alternately switched between 'UTC', so that the second hand 61 is moved towards the side at which the switching is made (step S312). Also, whenever the stem C1 is rotated by one step (step S313), the shift time is switched, so that the minute hand 62 and the hour hand 63 are moved (step S314). Also in the pattern 2, the same display and operations are performed, except for the position of the mode indicator 66.

When the push-button switch B3 is pushed, the mode switching ending operation is over (steps S304, S315). When the mode switching ending operation is over at the state of the mode 1 or the mode 2, the state proceeds to the setting state of the start month and start time of the daylight-saving time. The setting state is expressed as the small hour hand 68 indicates the 1 o'clock direction in the small window 6. At the setting state, the second hand 61 indicates the 3 o'clock position, thereby indicating that the start month is March. Also, the minute hand 62 and the hour hand 63 indicate a position of 2 o'clock, thereby indicating that the start time is 2:00. Also, the mode indicator 66 indicates the upward direction (a direction of the north latitude 90°) (FIG. 10A), thereby indicating that the start time is '0 o'clock'. At this state, when the push-button switch B1 is pushed, the start month is sequentially changed, so that the second hand 61 is moved. Also, when the push-button switch B4 is pushed, the start time is switched between 0 o'clock and 24 o'clock and the direction indicated by the mode indicator 66 is moved to a position of the side switched between the north latitude 90° and the south latitude 90°. Also, when the stem C1 is rotated, the start time is changed by a predetermined hour (for example, 1 hour) whenever the rotating operation of one step is performed, so that the direction indicated by the hour hand 63 is moved (steps S601 to S606).

Figure 10B:
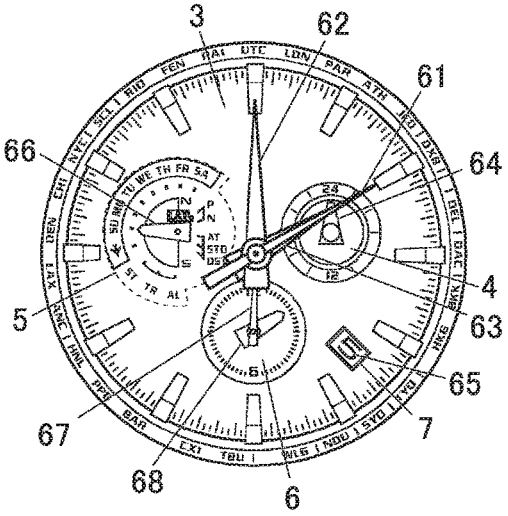

At the setting state of the start month and the start time, when the push-button switch B1 is pushed to end the setting (step S607), the state proceeds to the setting state of the start date, so that the small hour hand 68 indicates the 2 o'clock direction. In the pattern 1, the state proceeds to a state where the start date of the daylight-saving time is to be set by a day of week, and in the pattern 2, the state proceeds to a state where the start date of the daylight-saving time is to be set by a date (step S608). In case of the pattern 1, as shown in FIG. 10B, the second hand 61 indicates any one of the 1 o'clock to 5 o'clock directions, thereby indicating that the start date is one of the first week to the fourth week or final week. Also, the mode indicator 66 indicates any one of the marks 'SU' to 'SA' in the area 5, thereby indicating the start day. Here, the second hand 61 indicates the 2 o'clock position and the mode indicator 66 indicates the mark 'SU', thereby indicating that second Sunday is the start date. At this state, when the push-button switch B1 is pushed, the week of the start date is sequentially changed and the second hand 61 is moved, and when the push-button switch B4 is pushed, the start day is sequentially changed and the mode indicator 66 is moved (steps S611 to S614).

Figure 10C:
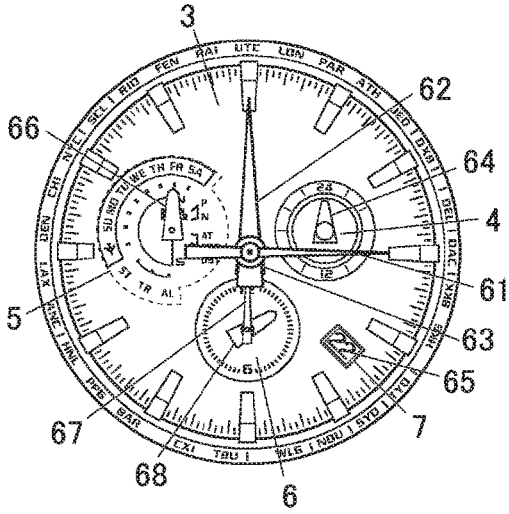

On the other hand, in case of the pattern 2, as shown in FIG. 10C, the hour hand 63 and the minute hand 62 indicate the 12 o'clock direction, the mode indicator 66 indicates the north latitude 90° direction (the mode indicator 66 may be enabled to indicate a direction deviating from the designation range of the days), and the date wheel 65 is rotated to expose the mark '22' from the opening 7, thereby indicating that the start date is twenty-second day of the month. At this state, when the stem C1 is rotated, the date wheel 65 is rotated by the days corresponding to the number of rotation steps, so that the start date is changed (steps S621, S622).

Figure 11A:
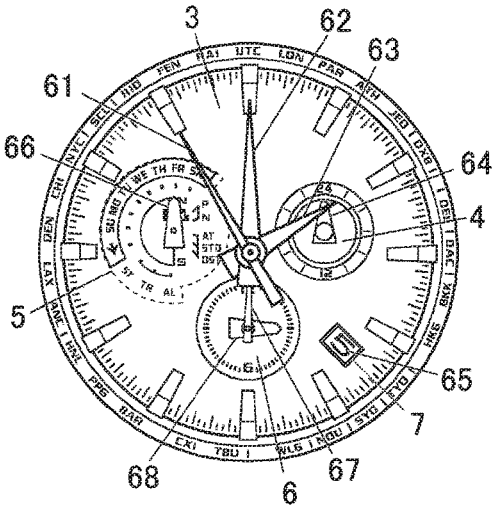
FIGS. 11A, 11B and 11C depict an example of correction by the local time setting correction processing.

At the setting state of the start date, when the push-button switch B3 is pushed and the correction of the start date is thus over ("YES" in steps S615, S623), the state proceeds to the setting state of the end date of the daylight-saving time. First, the setting state of the end month and end time of the daylight-saving time is made. As shown in FIG. 11A, this setting state is displayed as the small hour hand 68 indicates the 3 o'clock direction in the small window 6. At this setting state, the second hand 61 indicates an 11 o'clock position, thereby indicating that the end month is November. Also, the minute hand 62 and the hour hand 63 indicate the position of 2 o'clock, thereby indicating that the end time is 2 o'clock. Also, the mode indicator 66 indicates the upward direction (the north latitude 90° direction), thereby indicating that the end time is '0 o'clock'. At this state, when the push-button switch B1 is pushed, the end month is sequentially changed, so that the second hand 61 is moved. Also, when the push-button switch B4 is pushed, the end time is switched between 0 o'clock and 24 o'clock, so that the direction indicated by the mode indicator 66 is moved between the north latitude 90° and the south latitude 90°. Also, when the stem C1 is rotated, the end time is changed by predetermined time (for example, one hour) whenever the rotating operation of one step is performed, so that the direction indicated by the hour hand 63 is moved (steps S631 to S636).

Figure 11B:
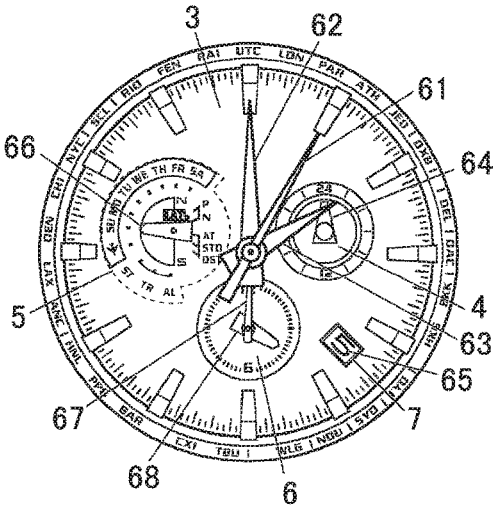

At the setting state of the end month and the end time, when the push-button switch B1 is pushed and the setting is thus over (step S637), the state proceeds to the setting state of the end date and the small hour hand 68 indicates the 4 o'clock direction. In the pattern 1, the state proceeds to the state of setting the end date of the daylight-saving time with a day of week, and in the pattern 2, the state proceeds to the state of setting the end date of the daylight-saving time with a date (step S638). In case of the pattern 1, as shown in FIG. 11B, the hour hand 63 and the minute hand 62 are arranged in the 12 o'clock direction and the second hand 61 indicates any one of the 1 o'clock to 5 o'clock directions, thereby indicating that the end date is one of the first to fourth weeks and the final week. Also, the mode indicator 66 indicates any one of the marks 'SU' to 'SA' in the area 5, thereby indicating the end day.

Here, the second hand 61 indicates the 1 o'clock position and the mode indicator 66 indicates the mark 'SU', thereby indicating that first Sunday is the end date. At this state, when the push-button switch B1 is pushed, the week of the end date is sequentially changed and the second hand 61 is moved, and when the push-button switch B4 is pushed, a day of week of the end day is sequentially changed and the mode indicator 66 is moved (steps S641 to S644).

Figure 11C:
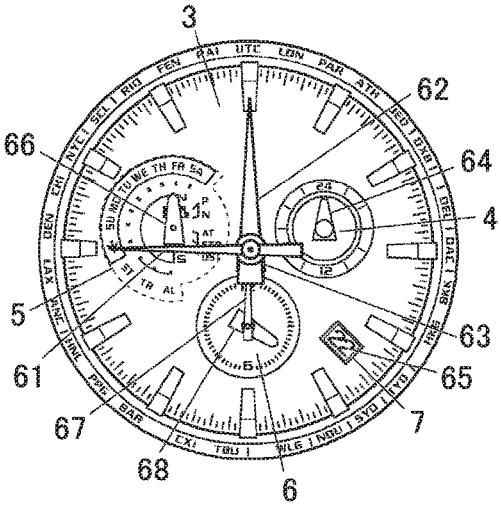

On the other hand, in case of the pattern 2, as shown in FIG. 11C, the hour hand 63, the minute hand 62 and the mode indicator 66 indicate the north latitude 90° direction, and the date wheel 65 is rotated to expose the mark '22' from the opening 7, thereby indicating that the end day is twenty-second day of the month. At this state, when the stem C1 is rotated, the date wheel 65 is rotated by the days corresponding to the number of rotation steps, so that the end day is changed (steps S651, S652).

At the setting state of the end date, when the push-button switch B3 is pushed and the correction of the end date is thus over ("YES" in steps S645, S653), the state proceeds to a correction confirmation screen of the time zone and the daylight-saving time. When the stem C1 is returned from the two-step pullout state by one step or more and the correction is thus completed, the corrected settings are reflected are stored in the city user correction data 43*a* or the map user correction data 43*b*.

As described above, the analog electronic timepiece 1 of the illustrative embodiment has the city time difference information 42*b*, the city daylight-saving time information 42*c*, the time difference map 48*b*, the time difference information 48*c* and the daylight-saving time information 48*d* configured to associate and store therein the local time information corresponding to each of the plurality of predetermined geographical positions with the geographical positions, and the CPU 41. The CPU 41 is configured to function as the update information acquisition unit 41*a* configured to acquire the user correction data relating to the local time information of the region including the current position, and the local time setting unit 41*b* configured to set the local time by referring to the user correction data when the user correction data corresponding to the current position has been acquired, and to set the local time by referring to the local time information when the user correction data has not been acquired.

That is, according to the analog electronic timepiece 1, when the local time setting is updated in the region for which the user wants to acquire the local time, the updated local time setting information is acquired as the user correction data by the user operation, and the user correction data is continuously used. Therefore, it is possible to acquire the correct local time easily and continuously, in correspondence to the change of the time zone setting and the implementation setting of the daylight-saving time.

Also, the local time setting information includes the information relating to the time zone and the daylight-saving time implementation information, and the effective geographical range of the user correction data is set based on the range in which the daylight-saving time implementation information corresponding to the current position is effective. Therefore, it is possible to easily define the effective range, and to acquire the local time in which the correct local time setting information has been reflected with the simple processing.

Also, the satellite radio wave receiving and processing unit 48 configured to acquire the information relating to the current position is provided, and the CPU 41 configured to function as the local time setting unit 41*b* is configured to determine the acquired current position as the applying target position of the local time setting information. Therefore, when the current position is acquired, the local time setting information corresponding to the current position is rapidly acquired.

Also, the satellite radio wave receiving and processing unit 48 is configured to operate as the reception unit configured to receive the radio waves from the positioning satellites and the position computation unit configured to compute the current position based on the received radio waves. Therefore, it is possible to easily and correctly acquire the current position in the various regions of the world in which the radio waves from the positioning satellites of the required number can be received, and to acquire the local time by selecting the local time setting information corresponding to the current position.

Also, the CPU 41 configured to function as the update information acquisition unit 41*a* is configured to associate the effective range of the daylight-saving time implementation information corresponding to the acquired current position with the user correction data. Therefore, at a situation where the current position is acquired in advance, the user can appropriately store the local time setting information in the region including the current position in the RAM 43 and continue to use the same simply by setting the user correction data at the current position.

Also, the RAM 43 (the city user correction data 43*a* and the map user correction data 43*b*) configured to function as the update information storage unit for storing the recently acquired user correction data is provided. When the acquired current position is not in the region associated with the user correction data, the CPU 41 configured to function as the local time setting unit 41*b* acquires the local time by referring to the city time difference information 42*b* and the city daylight-saving time information 42*c* of the ROM 42 or the time difference map 48*b*, the time difference information 48*c* and the daylight-saving time information 48*d* without referring to the user correction data, and the CPU 41 configured to function as the update information acquisition unit 41*a* deletes the user correction data that have not been referred to. Therefore, in particular, when the usual effective range of the daylight-saving time implementation information is different from the effective range of the local time setting information corresponding to the user correction data, it is possible to prevent the user correction data from being kept all the time. Also, the storage data is minimized in this way, so that it is possible to suppress the capacity of the RAM 43 and to reduce the operation of referring to the unnecessary user correction data upon the local time setting processing.

Also, the operation unit 47 configured to receive the user operation is provided, and the CPU 41 configured to function as the current position acquisition unit 41*d* is configured to acquire one of the predetermined cities of the world, which is selected in accordance with the input operation received through the operation unit 47, as the current position. Therefore, even though the user does not input the detailed positional information, it is possible to determine the appropriate current position. Also, it is possible to acquire the correct local time by using the latest local time setting information corresponding to the current position easily and appropriately.

Also, the geographical position of the selection target is denoted by the city name, so that the user can select the current position more easily and intuitively.

Also, the operation unit 47 configured to receive the user operation is provided, and the CPU 41 configured to function as the update information acquisition unit 41*a* is configured to acquire the user correction data in accordance with the content of the user operation received through the operation unit 47. Therefore, in the electronic timepiece that has a limitation on the communication with the outside and is difficult to update the entire local time setting information to the latest information and to acquire the necessary local time setting information in real time and automatically, it is possible to easily acquire the latest local time setting information in the necessary region and to continuously use the changed setting, so that it is possible to reduce the user's labor on the operation of setting the local time and to acquire the correct local time.

Also, the user correction data may include the information relating to the effective period of the user correction data. Therefore, it is possible to reduce the labor of cancelling the temporary setting due to the temporary statute and the temporary display depending on the user's situation after the setting and to acquire the correct local time within the range of the effective period.

Also, the analog electronic timepiece 1 has the timer circuit 46 configured to count the date and time, the indicators 61 to 68 configured to display the date and time and the stepping motors 81 to 85. The CPU 41 configured to function as the local time computation unit 41*c* is configured to convert the date and time, which is to be counted by the timer circuit 46 in correspondence to the setting of the local time made by the local time setting unit 41*b*, into the local time, and to indicate the converted local time by the indicators 61 to 68.

That is, according to the analog electronic timepiece 1, it is possible to compute and display the correct local time easily and continuously, in correspondence to the updated local time setting information. Therefore, the user can continue to acquire the correct local time in the various regions of the world even after the initial data of the local time setting information kept by the analog electronic timepiece 1 is changed.

In the meantime, the present invention is not limited to the above illustrative embodiment, and can be diversely changed.

For example, in the above illustrative embodiment, the setting and the local time display are performed in the analog electronic timepiece. However, the present invention can also be applied to a digital electronic timepiece having a digital display screen and an electronic timepiece having both a digital display screen and indicators. In this case, the setting state, the mode, the method of correcting the setting and the like may be displayed, depending on a size of the digital display screen, the number of displayable characters and the like.

Also, in the above illustrative embodiment, the user correction data once set is effective until a different setting is made for the same region or city or until the local time information for the different region or city is referred to, and is also effective until the effective period has elapsed. However, the user correction data may include a flag for defining validity or invalidity of the setting data. Also, the user correction data once set may be read out and corrected.

Also, in the above illustrative embodiment, the corrected same local time setting information (user correction data) is used for the current position acquired in the setting area of the parameters relating to the same daylight-saving time. However, the same local time setting information for which the correction has been performed only at the current position in the single geographical block or a predetermined number of adjacent geographical blocks may be used.

Also, in the above illustrative embodiment, the correction of the time zone and the correction of the daylight-saving time implementation information are continuously performed. However, only any one correction may be performed. In this case, the time zone and the daylight-saving time implementation information, which are separately corrected with respect to the same region, may be collectively stored in the map user correction data 43*b*, as one setting.

Also, in the above illustrative embodiment, the local time setting information is corrected with respect to the acquired current position. However, the local time setting information may be corrected at a position different from the current position by inputting both the positional information and the local time setting information to be corrected. For example, in the local time setting correction processing, when it is determined in the determination processing of step S101 that the current position is not kept, the processing may proceed to the processing of acquiring the information of the correction target position, and after the target position is acquired, the processing may proceed to the processing after step S102.

Also, in the above illustrative embodiment, both the setting of the local time based on the city setting and the setting of the local time based on the reception of the radio wave from the positioning satellite can be made. However, only any one setting may be made. Also in the manual setting, the latitude and the longitude, not the city setting, may be set by the input operation. Also, even when the city setting is made, a table for converting the setting into the latitude and the longitude may be kept, and the local time setting information of the geographical block to which the latitude and the longitude belong may be set in the same manner as the case where the local time setting information is set based on the reception of the radio wave from the positioning satellite. That is, in this case, since the correction data of the local time setting information with respect to the city selection and the correction data of the local time setting information with respect to the positioning result are commonly used, any one setting is not invalidated even when the current position acquisition by both the correction data is mixed. This aspect may be appropriately determined depending on the capacities of the RAM 43 and the storage unit in the satellite radio wave receiving and processing unit 48, the processing abilities of the CPU 41 and the control unit 48*a*, and the like.

Also, in the above illustrative embodiment, the city time difference information 42*b* and the city daylight-saving time information 42*c* relating to the city setting, and the city user correction data 43*a* and the map user correction data 43*b*, which are the correction data by the user, are stored in the ROM 42 and the RAM 43 of the analog electronic timepiece 1, and the time difference map 48*b*, the time difference information 48*c* and the daylight-saving time information 48*d* relating to the local time setting information based on the radio wave from the positioning satellite are stored in the storage unit arranged in the module of the satellite radio wave receiving and processing unit 48. However, the above data may be collectively stored in any one storage unit. Also, it is not necessarily required to dispersedly execute the local time setting processing in the control unit 48*a* of the satellite radio wave receiving and processing unit 48 and the CPU 41. That is, the local time setting processing may be executed by one of the CPU 41 and the control unit 48*a* of the satellite radio wave receiving and processing unit 48.

Also, in the above illustrative embodiment, the city user correction data 43*a* and the map user correction data 43*b* are updated in accordance with the user operation received through the operation unit 47. However, the update information in the small region may be acquired from an external device, for example, a smart phone through near field wireless communication such as Bluetooth communication (registered trademark: Bluetooth). In this case, the detailed update setting can be performed more easily in the external device such as a smart phone and transmitted to the analog electronic timepiece 1.

Also, in the above illustrative embodiment, the positioning is performed by receiving the radio waves from the GPS satellites. However, the positional information may be acquired by using the radio waves from the satellites relating to other positioning systems, such as positioning satellites relating to GLONASS and GALILEO or in combination with the radio waves.

In addition, the details of the illustrative embodiment such as the configurations of the electronic timepiece, the contents and sequences of the processing, and the like can be appropriately changed without departing from the gist of the present invention.

Although the illustrative embodiments of the present invention have been described, the scope of the present invention is not limited to the illustrative embodiments and includes the scope defined in the claims and the equivalent scope thereto.

What is claimed is:

1. An electronic timepiece comprising:

a storage unit that associates and stores local time information with a corresponding geographical position, for each of a plurality of predetermined geographical positions; and a processor that acquires update information of a predetermined region that includes a selected geographical position, the selected geographical position being selected from among the plurality of geographical positions, wherein the update information includes (i) correction data which is set by a user and which is related to local time information corresponding to the selected geographical position, and (ii) information which is set by the user separately from the correction data and which is related to an effective period of the correction data, wherein when update information corresponding to a target position for setting local time is acquired, the processor sets the local time by referring to the acquired update information, wherein when the update information corresponding to a target position for setting local time is not acquired, the processor sets the local time by referring to the local time information, and wherein the processor deletes update information the effective period of which has elapsed.

2. The electronic timepiece according to claim 1, wherein the local time information includes time zone setting information and daylight-saving time implementation information, and wherein the predetermined region is set based on a range in which the daylight-saving time implementation information corresponding to the selected geographical position is effective.

3. The electronic timepiece according to claim 2, wherein the processor acquires information relating to a current position, and wherein the processor sets the local time of the target position by using the acquired current position as the target position.

4. The electronic timepiece according to claim 3, further comprising:

a satellite radio wave receiving and processing unit that receives radio waves from satellites and that computes the current position based on the received radio waves.

5. The electronic timepiece according to claim 4, wherein the processor associates the predetermined region including the current position with the update information by using the acquired current position as the selected geographical position.

6. The electronic timepiece according to claim 3, wherein the processor associates the predetermined region including the current position with the update information by using the acquired current position as the selected geographical position.

7. The electronic timepiece according to claim 1, wherein the processor acquires information relating to a current position, and wherein the processor sets the local time of the target position by using the acquired current position as the target position.

8. The electronic timepiece according to claim 7, further comprising:

a satellite radio wave receiving and processing unit that receives radio waves from satellites and that computes the current position based on the received radio waves.

9. The electronic timepiece according to claim 8, wherein the processor associates the predetermined region including the current position with the update information by using the acquired current position as the selected geographical position.

10. The electronic timepiece according to claim 7, wherein the processor associates the predetermined region including the current position with the update information by using the acquired current position as the selected geographical position.

11. The electronic timepiece according to claim 10, wherein the processor associates the predetermined region including the current position with the update information by using the acquired current position as the selected geographical position.

12. The electronic timepiece according to claim 1, further comprising:

an operation unit that receives an input operation, wherein the processor sets one of the plurality of geographical positions, which is selected in accordance with the input operation, as the target position.

13. The electronic timepiece according to claim 1, wherein the plurality of geographical positions are denoted by city names and are selected in accordance with an input operation.

14. The electronic timepiece according to claim 1, further comprising:

an operation unit that receives a user operation, wherein the processor acquires the update information in accordance with a content of the user operation received by the operation unit.

15. The electronic timepiece according to claim 1, further comprising:

a timer unit that counts date and time; and a display unit that displays the local time, wherein the processor converts the date and time into the local time, in correspondence to the set local time.

16. The electronic timepiece according to claim 1, wherein the processor acquires and stores a latest update information, wherein the processor determines whether or not a current position is in the predetermined region associated with the latest update information, and wherein when the processor determines that the current position is not in the predetermined region associated with the update information, the processor accesses the local time information without accessing the update information and deletes the update information which has not been accessed.

* * * * *